US011255240B1

(12) United States Patent
Glugla et al.

(10) Patent No.: US 11,255,240 B1
(45) Date of Patent: Feb. 22, 2022

(54) SYSTEMS AND METHODS FOR A COMBINED PRE-CHAMBER AND THERMACTOR AIR SYSTEM

(71) Applicant: Ford Global Technologies, LLC, Dearborn, MI (US)

(72) Inventors: Chris Glugla, Macomb, MI (US); Rani Kiwan, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/142,089

(22) Filed: Jan. 5, 2021

(51) Int. Cl.
*F01N 3/20* (2006.01)
*F02P 5/04* (2006.01)
*F02B 1/14* (2006.01)

(52) U.S. Cl.
CPC ..... *F01N 3/2006* (2013.01); *F02B 1/14* (2013.01); *F02P 5/045* (2013.01)

(58) Field of Classification Search
CPC ..... F02P 5/045; F01N 3/2006; F02B 1/14
USPC ..... 701/113
See application file for complete search history.

(56) References Cited

U.S. PATENT DOCUMENTS 3,995,604 A * 12/1976 Brandstetter ..... F02B 19/1028 123/277
4,161,927 A * 7/1979 Yagi ..... F02B 19/1028 123/256
4,244,329 A * 1/1981 Ting ..... F02B 21/00 123/261
4,406,260 A * 9/1983 Burley ..... F02B 19/02 123/258
8,499,546 B2 8/2013 Thannasiu et al.
8,683,786 B2 4/2014 Ruona et al.
8,955,473 B2 2/2015 Zhang
9,249,746 B2 2/2016 Geckler et al.
2010/0263639 A1 10/2010 Uhrich et al.
2014/0209057 A1* 7/2014 Pouring ..... F02B 19/1023 123/257
2020/0200068 A1* 6/2020 Schock ..... F02B 21/02
2021/0131337 A1* 5/2021 Bromberg ..... F02B 49/00

OTHER PUBLICATIONS

Thomas, J. et al., "Systems and Methods for Increasing Oxygen Levels in an Active Pre-Chamber," U.S. Appl. No. 16/800,407, filed Feb. 25, 2020, 47 pages.
Glugla, C. et al., "Systems and Methods for Exhaust Gas Recirculation With a Pre-Chamber," U.S. Appl. No. 16/838,788, filed Apr. 2, 2020, 69 pages.

* cited by examiner

*Primary Examiner* — Mahmoud Gimie
(74) *Attorney, Agent, or Firm* — Geoffrey Brumbaugh; McCoy Russell LLP

(57) ABSTRACT

Methods and systems are provided for reducing emissions during an engine cold start. In one example, a method may include, during emission control device heating, initiating combustion in a cylinder via a spark plug directly coupled to the cylinder and providing secondary air via a turbulent jet ignition system. In this way, an amount of hydrocarbons in feedgas provided to the emission control device prior to the emission control device reaching its light-off temperature may be reduced.

17 Claims, 11 Drawing Sheets

SYSTEMS AND METHODS FOR A COMBINED PRE-CHAMBER AND THERMACTOR AIR SYSTEM

FIELD

The present description relates generally to methods and systems for a secondary air introduction system for an internal combustion engine.

BACKGROUND/SUMMARY

Exhaust emission control devices, such as catalytic converters (also referred to herein as "catalysts"), are included in an exhaust system of a vehicle to treat exhaust gas components, such as hydrocarbons from unburnt fuel, prior to emission from the vehicle via a tail pipe. However, the exhaust emission control devices achieve higher emission reduction after reaching a predetermined operating temperature (e.g., a light-off temperature). Thus, undesirable vehicle emissions may be the greatest prior to the emission control devices reaching the predetermined operating temperature. To lower such vehicle emissions, various methods attempt to raise a temperature of the emission control device as fast as possible. For example, catalysts may be placed in a close-coupled position to the engine to minimize heat losses and catalyst warm-up time after an engine cold start. Other solutions aim to reduce an amount of hydrocarbons in the exhaust gas provided to the emission control device during the cold start.

One such method for reducing hydrocarbon emissions during warm-up includes introducing secondary air into the exhaust gas upstream of the emission control device. One example approach is shown by Zhang et al. in U.S. Pat. No. 8,955,473 B2. Therein, a port electric thermactor air (PETA) system is used to provide oxygen-rich air from an intake passage of an engine to an exhaust passage upstream of an emission control device. A vane pump or other air induction device may be used to draw the air from the intake passage and deliver it to the exhaust passage. The oxygen-rich air may react with unburnt hydrocarbons in the exhaust passage prior to reaching the emission control device.

However, the inventors herein have recognized potential issues with such systems. As one example, PETA systems are typically expensive and add to a cost and complexity of the vehicle system. Further, the inventors herein have advantageously recognized that some vehicle systems already include components that may be used to generate and supply air to the exhaust system. In particular, an engine may be equipped with a turbulent jet ignition (TJI) system that ignites an air-fuel mixture within a cylinder via combustion in a pre-combustion chamber, referred to herein as a "pre-chamber." The pre-chamber may be a walled chamber located in a clearance volume of the cylinder (also referred to herein as a "main chamber" or "main combustion chamber") and may include a spark plug. High pressure air and fuel are introduced into the pre-chamber via the TJI system, and when ignition is requested, the spark plug in the pre-chamber is actuated, igniting the air and fuel in the pre-chamber. Jets of flame and hot gas exit the pre-chamber and enter the cylinder via one or more small orifices in the pre-chamber walls. These jets ignite the air-fuel mixture in the cylinder to produce torque. As such, the inventors herein have identified that the TJI system may be used as either a thermactor or for ignition by adjusting operation of the TJI system, including fuel and spark delivery, based on a temperature of a catalyst, without using an external thermactor system.

In one example, the issues described above may be addressed by a method, comprising: during heating of a catalyst of an exhaust system coupled to an engine, initiating combustion in a cylinder via a spark plug directly coupled to the cylinder and providing secondary air via a turbulent jet system having an igniter. In this way, the air provided by the turbulent jet system may react with unburnt hydrocarbons following combustion, thereby reducing an amount of unburnt hydrocarbons that are delivered to the catalyst during warm-up.

As one example, the turbulent jet system may include a compressor positioned in an air delivery passage, a pre-chamber coupled to the cylinder, and a pre-chamber injector coupled to the pre-chamber and to the air delivery passage, downstream of the compressor, via a first port. As such, providing the secondary air via the turbulent jet system may include pressurizing the secondary air via the compressor. Further, in some examples, the secondary air, pressurized by the compressor, may be delivered to the pre-chamber via the injector. The secondary air may flow out of the pre-chamber to the cylinder, for example. In order to oxidize hydrocarbons after combustion in the cylinder, the secondary air may be injected near an end of an expansion stroke of the cylinder, such as close to bottom dead center (BDC) of the expansion stroke, and/or during an exhaust stroke of the cylinder. In some examples, the air delivery passage of the turbulent jet system may be coupled to an exhaust runner of the cylinder via a second port, and a valve may be disposed in the air delivery passage downstream of the first port and upstream of a second port. In such examples, providing the secondary air via the turbulent jet system may include adjusting a position of the valve. For example, the valve may be adjusted to a partially open position during a first operating condition, the valve may be adjusted to a fully open position during a second operating condition, and the valve may be adjusted to a fully closed position during a third operating condition. Further, the secondary air may be injected into the pre-chamber via the pre-chamber injector during each of the first operating condition and the third operating condition and not during the second operating condition. In this way, the secondary air may be provided to the exhaust runner and provided to the cylinder via the pre-chamber during the first operating condition, the secondary air may be provided to only the exhaust runner during the second operating condition, and the secondary air may be provided only to the cylinder via the pre-chamber during the third operating condition. The first operating condition may include a hydrocarbon output of the engine being greater than an upper threshold, the second operating condition may include the hydrocarbon output of the engine being less than the upper threshold and greater than a lower threshold, and the third operating condition may include the hydrocarbon output of the engine being less than the lower threshold. However, a hydrocarbon output of the vehicle may remain less than a threshold vehicle hydrocarbon output during each of the first, second, and third operating conditions. Additionally or alternatively, the first operating condition may include a duration since engine start being less than a first threshold duration, the second operating condition may include the duration since the engine start being greater than the first threshold duration and less than a second threshold duration, and the third operating condition may include the duration since the engine start being greater than the second threshold duration.

As another example, the heating of the catalyst may be responsive to a temperature of the catalyst being less than a threshold temperature, and the method may further comprise initiating combustion in the cylinder via the turbulent jet system after the temperature of the catalyst reaches or exceeds the threshold temperature. For example, initiating combustion in the cylinder via the turbulent jet system may include injecting fuel into the air delivery passage upstream of the first port to generate an air-fuel mixture, injecting the air-fuel mixture into the pre-chamber during a compression stroke of the cylinder via the pre-chamber injector, and actuating the igniter of the turbulent jet system at a desired ignition timing. For example, the igniter may be coupled to the pre-chamber. Further, initiating combustion in the cylinder via the turbulent jet system may include not actuating the spark plug directly coupled to the cylinder. Thus, the spark plug directly coupled to the cylinder may be used to provide ignition when the turbulent jet system is operated to provide secondary air while heating the catalyst, and the pre-chamber of the turbulent jet system may be used to provide ignition by actuating the igniter while heating the catalyst is not requested.

In an alternative configuration, the pre-chamber may include separate fuel and air injectors (instead of a common injector for both). For example, during a compression stroke, air may be injected via a pre-chamber air injector, and fuel may be injected via a pre-chamber fuel injector. The injected air and fuel may be ignited via the igniter of the turbulent jet system after the injections. Then, late in an expansion stroke or during an exhaust stroke of the same engine cycle, only air may be injected via the pre-chamber air injector (e.g., fuel is not injected via the pre-chamber fuel injector) to provide secondary air to the cylinder via the pre-chamber. In this way, the pre-chamber may be used during cold start to both provide ignition and secondary air into the cylinder.

By introducing secondary air at one or more locations coupled to the cylinder (e.g., the pre-chamber and the exhaust runner), late cycle hydrocarbons that were not burned during combustion in the cylinder may react with oxygen in the secondary air. As a result, the amount of hydrocarbons provided to the catalyst prior to the catalyst reaching its light-off temperature may be reduced. Further, the hydrocarbon oxidation may be enhanced due to the higher in-cylinder temperatures relative to providing secondary air to an exhaust manifold, for example. Vehicle costs and complexity may be reduced by providing the secondary air via the turbulent jet system compared with including an external thermactor pump and delivery lines. Overall, vehicle emissions prior to the catalyst reaching its light-off temperature may be reduced while the engine may operate with increased efficiency and reduced fuel consumption after the catalyst reaches its light-off temperature due to the turbulent jet system providing ignition.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
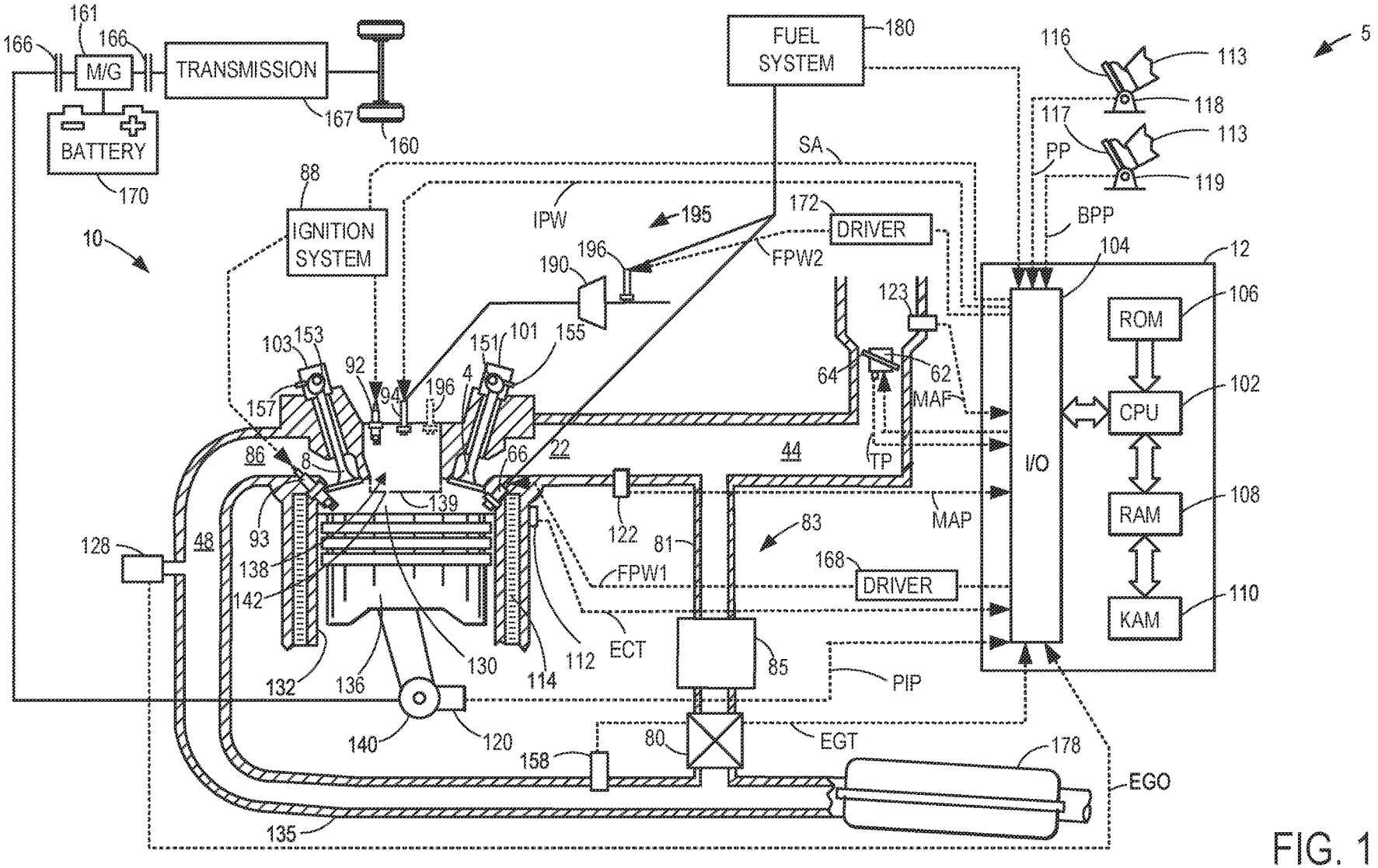
FIG. 1 shows an embodiment of a cylinder included in an engine system that includes a turbulent jet ignition system.

The following description relates to systems and methods for reducing exhaust emissions during an engine start. The engine may be the engine schematically shown in FIG. 1, for example, including a turbulent jet ignition (TJI) system that combines pre-chamber ignition and thermactor air (e.g., secondary air injection) functionality. In some examples, the TJI system may provide air injection only via the pre-chamber, such as shown in FIG. 1, whereas in other examples, the TJI system may be extended to include additional plumbing to exhaust runners of the engine, such as shown in FIGS. 2A-2D. The TJI system may be operated to provide secondary air injection during an engine cold start and to provide ignition when the engine cold start is not present, such as according to the example method of FIG. 3. For example, the TJI system may be used to inject air into the cylinders and/or exhaust ports of the engine while a hydrocarbon output of the engine is relatively high, prior to an emission control device (e.g., catalyst) reaching its light-off temperature. The injected air may react with unburnt hydrocarbons before the hydrocarbons are delivered to the emission control device. Further, the extended TJI system may be operated in a plurality of different modes, as illustrated in FIGS. 4-7, based on a desired secondary air introduction location, which may be determined based on an estimated hydrocarbon output of the engine, for example. A prophetic example timeline for adjusting operation of the TJI system based on whether a cold start condition is present is shown in FIG. 8.

Turning now to the figures, FIG. 1 shows a partial view of a single cylinder 130 of an internal combustion engine 10 that may be included in a vehicle 5. Engine 10 may be a multi-cylinder engine, and only one cylinder 130 is shown in FIG. 1. Cylinder (e.g., combustion chamber) 130 includes a coolant sleeve 114 and cylinder walls 132, with a piston 136 positioned therein and connected to a crankshaft 140. Combustion chamber 130 is shown communicating with an intake manifold 44 via an intake valve 4 and an intake port 22 and with an exhaust manifold 48 via an exhaust valve 8 and an exhaust port 86. A throttle 62 including a throttle plate 64 may be provided in an intake passage upstream of intake manifold 44 for varying a flow rate and/or pressure of intake air provided to the engine cylinders.

Engine 10 may be controlled at least partially by a controller 12 and by input from a vehicle operator 113 via an accelerator pedal 116 and an accelerator pedal position sensor 118 and via a brake pedal 117 and a brake pedal position sensor 119. Accelerator pedal position sensor 118 may send a pedal position signal (PP) to controller 12 corresponding to a position of accelerator pedal 116, and brake pedal position sensor 119 may send a brake pedal position (BPP) signal to controller 12 corresponding to a position of brake pedal 117.

In some examples, vehicle 5 may be a hybrid vehicle with multiple sources of torque available to one or more vehicle wheels 160. In other examples, vehicle 5 is a conventional vehicle with only an engine. In the example shown in FIG. 1, the vehicle includes engine 10 and an electric machine 161. Electric machine 161 may be a motor or a motor/generator and thus may also be referred to herein as an electric motor. Electric machine 161 receives electrical power from a traction battery 170 to provide torque to vehicle wheels 160. Electric machine 161 may also be operated as a generator to provide electrical power to charge battery 170, for example, during a braking operation.

Crankshaft 140 of engine 10 and electric machine 161 are connected in a powertrain via a transmission 167 to vehicle wheels 160 when one or more clutches 166 are engaged. In the depicted example, a first clutch 166 is provided between crankshaft 140 and electric machine 161, and a second clutch 166 is provided between electric machine 161 and transmission 167. Controller 12 may send a signal to an actuator of each clutch 166 to engage or disengage the clutch, so as to connect or disconnect crankshaft 140 from electric machine 161 and the components connected thereto, and/or connect or disconnect electric machine 161 from transmission 167 and the components connected thereto. Transmission 167 may be a gearbox, a planetary gear system, or another type of transmission. The powertrain may be configured in various manners including as a parallel, a series, or a series-parallel hybrid vehicle.

An exhaust passage 135 can receive exhaust gases from other cylinders of engine 10 in addition to cylinder 130. An exhaust gas sensor 128 is shown coupled to exhaust passage 135 upstream of an emission control device 178. Exhaust gas sensor 128 may be selected from among various suitable sensors for providing an indication of an exhaust gas air-fuel ratio (AFR), such as a linear oxygen sensor or UEGO (universal or wide-range exhaust gas oxygen), a two-state oxygen sensor or EGO (as depicted), a HEGO (heated EGO), a NOx sensor, a HC sensor, or a CO sensor, for example. Emission control device 178 may be a three-way catalyst, a NOx trap, various other emission control devices, or combinations thereof.

In the depicted view, intake valve 4 and exhaust valve 8 are located at an upper region of combustion chamber 130. Intake valve 4 and exhaust valve 8 may be controlled by controller 12 using respective cam actuation systems including one or more cams. The cam actuation systems may utilize one or more of variable displacement engine (VDE), cam profile switching (CPS), variable cam timing (VCT), variable valve timing (VVT), and/or variable valve lift (VVL) systems to vary valve operation. In the depicted example, intake valve 4 is controlled by an intake cam 151, and exhaust valve 8 is controlled by an exhaust cam 153. The intake cam 151 may be actuated via an intake valve timing actuator 101 and the exhaust cam 153 may be actuated via an exhaust valve timing actuator 103 according to set intake and exhaust valve timings, respectively. In some examples, the intake valves and exhaust valves may be deactivated via the intake valve timing actuator 101 and exhaust valve timing actuator 103, respectively. The position of intake cam 151 and exhaust cam 153 may be determined by camshaft position sensors 155 and 157, respectively.

In some examples, the intake and/or exhaust valve may be controlled by electric valve actuation. For example, cylinder 130 may alternatively include an intake valve controlled via electric valve actuation and an exhaust valve controlled via cam actuation, including CPS and/or VCT systems. In still other examples, the intake and exhaust valves may be controlled by a common valve actuator or actuation system or a variable valve timing actuator or actuation system. The various valve control systems may be used to vary a timing, open duration, and lift of intake valve 4 and exhaust valve 8.

Cylinder 130 can have a compression ratio, which is a ratio of volumes when piston 136 is at bottom dead center to top dead center. Conventionally, the compression ratio is in a range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

As a non-limiting example, cylinder 130 is shown including a cylinder fuel injector 66. Fuel injector 66 is shown coupled directly to combustion chamber 130 for injecting fuel directly therein in proportion to a pulse-width of a signal FPW1 received from controller 12 via an electronic driver 168. In this manner, fuel injector 66 provides what is known as direct injection (hereafter also referred to as "DI") of fuel into cylinder 130. In another example, fuel injector 66 may be a port injector providing fuel into the intake port upstream of cylinder 130. Further, while FIG. 1 shows fuel injected to the cylinder via a single injector, the engine may alternatively be operated by injecting fuel via multiple injectors, such as one direct injector and one port injector. For example, both port and direct injectors may be included in a configuration that is known as port fuel and direct injection (PFDI). In such a configuration, controller 12 may vary a relative amount of injection from each injector. In some examples, cylinder 130 may include additional fuel injectors.

Fuel may be delivered to fuel injector 66 from a high-pressure fuel system 180 including one or more fuel tanks, fuel pumps, and a fuel rail. Alternatively, fuel may be delivered by a single stage fuel pump at a lower pressure. Further, while not shown, the fuel tanks may include a pressure transducer providing a signal to controller 12. Fuel tanks in fuel system 180 may hold fuel with different fuel qualities, such as different fuel compositions. These differences may include different alcohol content, different octane, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of ethanol and water, a mixture of water and methanol, a mixture of alcohols, etc. In this way, air and fuel are delivered to cylinder 130, which may produce a combustible air-fuel mixture.

Fuel may be delivered by fuel injector 66 to cylinder 130 during a single cycle of the cylinder. Further, the distribution and/or relative amount of fuel delivered from cylinder fuel injector 66 may vary with operating conditions. Furthermore, for a single combustion event, multiple injections of the delivered fuel may be performed per cycle. The multiple injections may be performed during the compression stroke, intake stroke, or any appropriate combination thereof.

In the example shown in FIG. 1, engine 10 includes a turbulent jet ignition (TJI) system 195, which is a combined pre-chamber ignition and thermactor air system. TJI system 195 may also be referred to herein as a turbulent jet system. To provide pre-chamber ignition under select operating modes, each cylinder 130 of engine 10 includes a pre-chamber 138 of TJI system 195. Pre-chamber 138 is defined by pre-chamber walls 139 and includes a pre-chamber spark plug 92 (e.g., an igniter) and a pre-chamber injector 94. Pre-chamber injector 94 is shown directly coupled to pre-chamber 138 for injecting air or an air-fuel mixture into the pre-chamber. In some examples, pre-chamber injector 94 is an electromagnetic (e.g., solenoid) injector.

Air may be delivered to pre-chamber injector 94 from a compressor 190. Note that in relation to the pre-chamber air system, the term "air" may refer herein to ambient air, oxygen (e.g., $O_2$), hydrogen (e.g., $H_2$), another combustible gas, or a mixture of such gases. Compressor 190 may be driven by an electric motor via electrical power received from battery 170, for example. In some examples, compressor 190 may be driven at a constant speed to provide a desired pressure upstream of compressor 190. In other examples, the speed of compressor 190 may be varied in order to adjust the pressure upstream of compressor 190. Further, a pre-chamber fuel injector 196 is shown coupled upstream of compressor 190. However, in other examples, pre-chamber fuel injector 196 may be positioned downstream of compressor 190. Pre-chamber fuel injector 196 may directly inject fuel into an air delivery passage coupled to pre-chamber injector 94 in proportion to a pulse-width of a signal FPW2 received from controller 12 via an electronic driver 172. Fuel may be provided to pre-chamber fuel injector 196 by high-pressure fuel system 180, described above. Alternatively, fuel may be provided to pre-chamber fuel injector 196 from a dedicated pre-chamber fuel system that may be included within or distinct from high-pressure fuel system 180. The fuel provided by pre-chamber fuel injector 196 may mix with the air provided by compressor 190 before being delivered to pre-chamber injector 94. Pre-chamber injector 94 may inject the received air and/or fuel into pre-chamber 138 in proportion to a pulse-width of a signal IPW received from controller 12. Thus, both air and fuel are delivered to pre-chamber 138, which may produce an air-fuel mixture with an air/fuel ratio (AFR) that may differ from an AFR in cylinder 130. In one example, the AFR in pre-chamber 138 may be richer (e.g., have a higher proportion of fuel relative to air) than the AFR in cylinder 130. In another example, the AFR in the pre-chamber may be the same as the AFR in the cylinder. In yet another example, the AFR in pre-chamber 138 may be leaner (e.g., have a higher proportion of air relative to fuel) than the AFR in cylinder 130.

Note that compressor 190 and pre-chamber fuel injector 196 may provide air and fuel to the pre-chamber of every cylinder of engine 10. Further, during some operating conditions, pre-chamber fuel injector 196 may be disabled so that no fuel is injected via pre-chamber injector 94, as will be elaborated herein. For example, pre-chamber fuel injector 196 may be disabled when TJI system 195 is operated to provide secondary air injection to cylinder 130 instead of providing ignition to cylinder 130.

However, in an alternative configuration, pre-chamber 138 may include separate air and fuel injectors instead of a combined air and fuel injector. For example, instead of providing fuel to every pre-chamber of the engine via pre-chamber fuel injector 196 by including pre-chamber fuel injector 196 coupled to air delivery passage upstream of pre-chamber injector 94, pre-chamber fuel injector 196 may be directly coupled to pre-chamber 138 for directly injecting fuel therein. In such a configuration, pre-chamber injector 94 may inject only air (instead of air and/or fuel). Such a configuration may enable additional operating flexibility of TJI system 195 by separately controlling whether air, fuel, or both are injected into pre-chamber 138.

Further, pre-chamber walls 139 include a plurality of openings 142. The plurality of openings 142 provide orifices between pre-chamber 138 and cylinder 130, fluidically coupling an interior of pre-chamber 138 to an interior of cylinder 130. As such, during some conditions, gases may flow between the interior of pre-chamber 138 and the interior of cylinder 130. For example, the gases (e.g., air, fuel, and/or residual combustion gases) may flow through each of the plurality of openings 142 with a directionality and rate based on a pressure difference across each of the plurality of openings 142 (e.g., between the interior of pre-chamber 138 and the interior of cylinder 130). The plurality of openings 142 may also provide an ignition flame from pre-chamber 138 to cylinder 130, as will be elaborated below.

An ignition system 88 may provide an ignition spark to pre-chamber 138 via pre-chamber spark plug 92 in response to a spark advance signal SA from controller 12, under select operating modes. Thus, pre-chamber spark plug 92 comprises an igniter of TJI system 195. A timing of signal SA may be adjusted based on engine operating conditions and a driver torque demand. For example, spark may be provided at maximum brake torque (MBT) timing to maximize engine power and efficiency. Controller 12 may input engine operating conditions, including an engine speed, an engine load, and an exhaust gas AFR, into a look-up table, which may output the corresponding MBT timing for the input engine operating conditions. In other examples, spark may be retarded from MBT to prevent an occurrence of knock. In still other examples, spark may be retarded from MBT to reduce engine torque, such as due to a decrease in the driver-demanded torque or a transmission gear shift event. When pre-chamber spark plug 92 provides the ignition spark to pre-chamber 138, the air-fuel mixture within the pre-chamber may combust, with the increased pressure of combustion sending jets of flame and hot gases into cylinder 130 via the plurality of openings 142. The plurality of openings 142 may be arranged such that the jets of flame are evenly distributed in cylinder 130. The jets of flame may ignite the air-fuel mixture in cylinder 130, causing combustion. After combustion, a mixture of exhaust gases from both pre-chamber 138 and cylinder 130 may be exhausted from cylinder 130 to exhaust manifold 48 via opening of exhaust valve 8.

In the example shown in FIG. 1, each cylinder 130 of engine 10 further includes a main chamber spark plug 93 (e.g., a cylinder spark plug) for initiating combustion. Main chamber spark plug 93 is directly coupled to the main combustion chamber (e.g., combustion chamber 130) of the cylinder, and thus provides an igniter that is distinct from pre-chamber spark plug 92 of TJI system 195. Ignition system 88 may provide an ignition spark to cylinder 130 via main chamber spark plug 93 in response to the spark advance signal SA from controller 12, under select operating modes. A timing of signal SA may be adjusted based on engine operating conditions and a driver torque demand, similar to the manner described above with respect to pre-chamber spark plug 92. Thus, in the example shown in FIG. 1, cylinder 130 includes two different ignition sources (e.g., TJI system 195 and main chamber spark plug 93) for initiating combustion. One of the two different ignition sources may be used to combust the air-fuel mixture in the cylinder during engine operation, such as according to the method of FIG. 3. For example, main chamber spark plug 93 may be used to initiate combustion when TR system 195 is used to provide secondary air injection into the cylinder, such as during a cold start of engine 10.

External exhaust gas recirculation (EGR) may be provided to the engine via a high pressure EGR system 83, delivering exhaust gas from a zone of higher pressure in exhaust passage 135 to a zone of lower pressure in intake manifold 44, downstream of throttle 62, via an EGR passage 81. An amount EGR provided to intake manifold 44 may be varied by controller 12 via an EGR valve 80. For example, controller 12 may be configured to actuate and adjust a position of EGR valve 80 to adjust the amount of exhaust gas flowing through EGR passage 81. EGR valve 80 may be adjusted between a fully closed position, in which exhaust gas flow through EGR passage 81 is blocked, and a fully open position, in which exhaust gas flow through the EGR passage is maximally enabled. As an example, EGR valve 80 may be continuously variable between the fully closed position and the fully open position. As such, the controller may increase a degree of opening of EGR valve 80 to increase an amount of EGR provided to intake manifold 44 and decrease the degree of opening of EGR valve 80 to decrease the amount of EGR provided to intake manifold 44. As an example, EGR valve 80 may be an electronically activated solenoid valve. In other examples, EGR valve 80 may be positioned by an incorporated stepper motor, which may be actuated by controller 12 to adjust the position of EGR valve 80 through a range of discreet steps (e.g., 52 steps), or EGR valve 80 may be another type of flow control valve. Further, EGR may be cooled via passing through an EGR cooler 85 within EGR passage 81. EGR cooler 85 may reject heat from the EGR gases to engine coolant, for example.

Under some conditions, EGR system 83 may be used to regulate a temperature of the air and fuel mixture within the combustion chamber. Further, EGR may be desired to attain a desired engine dilution, thereby increasing fuel efficiency and emissions quality, such as emissions of nitrogen oxides. As an example, EGR may be requested at low-to-mid engine loads. Thus, it may be desirable to measure or estimate an EGR mass flow. EGR sensors may be arranged within EGR passage 81 and may provide an indication of one or more of mass flow, pressure, and temperature of the exhaust gas, for example. An amount of EGR requested may be based on engine operating conditions, including engine load (as estimated via accelerator pedal position sensor 118), engine speed (as estimated via a crankshaft acceleration sensor), engine temperature (as estimated via an engine coolant temperature sensor 112), etc. For example, controller 12 may refer to a look-up table having the engine speed and load as the input and output a desired amount of EGR corresponding to the input engine speed-load. In another example, controller 12 may determine the desired amount of EGR (e.g., desired EGR flow rate) through logic rules that directly take into account parameters such as engine load, engine speed, engine temperature, etc. In still other examples, controller 12 may rely on a model that correlates a change in engine load with a change in a dilution request, and further correlates the change in the dilution request with a change in the amount of EGR requested. For example, as the engine load increases from a low load to a mid load, the amount of EGR requested may increase, and then as the engine load increases from a mid load to a high load, the amount of EGR requested may decrease. Controller 12 may further determine the amount of EGR requested by taking into account a best fuel economy mapping for a desired dilution rate. After determining the amount of EGR requested, controller 12 may refer to a look-up table having the requested amount of EGR as the input and a signal corresponding to a degree of opening to apply to EGR valve 80 (e.g., as sent to the stepper motor or other valve actuation device) as the output.

Controller 12 is shown in FIG. 1 as a microcomputer, including a microprocessor unit 102, input/output ports 104, an electronic storage medium for executable programs and calibration values shown as a read only memory 106 in this particular example, a random access memory 108, a keep alive memory 110, and a data bus. Storage medium read-only (e.g., non-transitory) memory 106 can be programmed with computer readable data representing instructions executable by microprocessor unit 102 for performing the methods and routines described herein as well as other variants that are anticipated but not specifically listed.

Controller 12 may receive various signals from sensors coupled to engine 10, in addition to those signals previously discussed, including a measurement of inducted mass air flow (MAF) from a mass air flow sensor 123, an engine coolant temperature signal (ECT) from engine coolant temperature sensor 112 coupled to coolant sleeve 114, signal EGO from exhaust gas sensor 128, which may be used by controller 12 to determine the AFR of the exhaust gas, an exhaust gas temperature signal (EGT) from a temperature sensor 158 coupled to exhaust passage 135, a profile ignition pickup signal (PIP) from a Hall effect sensor 120 (or other type) coupled to crankshaft 140, a throttle position (TP) from a throttle position sensor coupled to throttle 62, and an absolute manifold pressure signal (MAP) from a MAP sensor 122 coupled to intake manifold 44. An engine speed signal, RPM, may be generated by controller 12 from signal PIP. The manifold pressure signal MAP from the manifold pressure sensor may be used to provide an indication of vacuum or pressure in the intake manifold.

Based on input from one or more of the above-mentioned sensors, controller 12 may adjust one or more actuators, such as cylinder fuel injector 66, throttle 62, pre-chamber spark plug 92, main chamber spark plug 93, pre-chamber fuel injector 196, pre-chamber injector 94, the intake/exhaust valves and cams, etc. The controller may receive input data from the various sensors, process the input data, and trigger the actuators in response to the processed input data based on instruction or code programmed therein corresponding to one or more routines, an example of which is described with respect to FIG. 3.

A greatest occurrence of hydrocarbon emissions may occur in the first few firing events after engine 10 is started. For example, an output of unburnt hydrocarbons from the engine may peak before emission control device 178 reaches its light-off temperature. As such, emission control device 178 may not be maximally effective at neutralizing (e.g., oxidizing) the hydrocarbons output by the engine when the hydrocarbon output is the highest, resulting in higher hydrocarbon tailpipe emissions. Therefore, TJI system 195 may be used to deliver additional (e.g., secondary) air to cylinder 130, as will be elaborated below with respect to FIG. 3. The secondary air may exothermically react with unburned hydrocarbons, and the exothermic reaction may heat exhaust system components, including emission control device 178, as well as reduce an amount of hydrocarbons provided to emission control device 178 before it reaches its light-off temperature, thereby reducing vehicle hydrocarbon emissions.

Continuing to FIGS. 2A-2D, an example configuration of an extended TJI system 200 (e.g., an extended pre-chamber and thermactor air system) that may be included in engine 10 introduced in FIG. 1 is shown. Components of FIGS. 2A-2D that function the same as components shown in FIG. 1 are numbered the same and will not be re-introduced. Further, it may be understood that components illustrated in FIG. 1 that are not shown in FIGS. 2A-2D may be present. Additionally, letters (e.g., "a," "b," and the like) designate a set of components included in or coupled to one cylinder of the multi-cylinder engine. That is, the "a" components (e.g., pre-chamber 138*a*) are included in or coupled to a first cylinder (e.g., cylinder 1), the "b" components (e.g., pre-chamber 138*b*) are included in or coupled to a second cylinder (e.g., cylinder 2), etc. In the example shown, "n" components are shown with respect to cylinder N, where N is any integer number of cylinders in the engine. Thus, extended TJI system 200 may be adapted to provide air and/or fuel to each cylinder of the engine.

Air is provided to compressor 190 via an air intake passage 202. In the example shown, pre-chamber fuel injector 196 is coupled to air intake passage 202 upstream of compressor 190. However, as noted above with respect to FIG. 1, in other examples, pre-chamber fuel injector 196 may be coupled downstream of compressor 190. After being compressed (e.g., pressurized) by compressor 190, the air (and fuel, in some examples) is delivered to a common delivery passage 208. Common delivery passage 208 includes a plurality of ports for delivering the air (and fuel) to the pre-chamber injector of each cylinder. In the example shown, ports 210*a*, 210*b*, and 210*n* deliver the air (or air and fuel) to pre-chamber injectors 94*a*, 94*b*, and 94*n*, respectively. Common delivery passage 208 further includes a plurality of ports downstream of a valve 212 for delivering the air to an exhaust runner of each cylinder. In the example shown, ports 214*a*, 214*b*, and 214*n* deliver the air from common delivery passage 208 to exhaust runner 86*a* of cylinder 1, exhaust runner 86*b* of cylinder 2, and exhaust runner 86*n* of cylinder N, respectively, when valve 212 is at least partially open. Valve 212 may be a solenoid valve, as shown, that is electronically controlled via controller 12. Because valve 212 regulates the flow (or supply) of air from common delivery passage 208 to exhaust runners 86*a*, 86*b*, and 86*n*, valve 212 may also be referred to herein as an exhaust runner supply valve. For example, valve 212 may be fully closed when de-energized and open when energized via a control signal from controller 12. When energized, adjusting an amount of current flowing through solenoid coils of valve 212 may adjust a degree of opening of valve 212. For example, the current may induce a magnetic field that pulls a plunger of valve 212 toward the solenoid coils, thereby opening the valve.

Figure 2A:
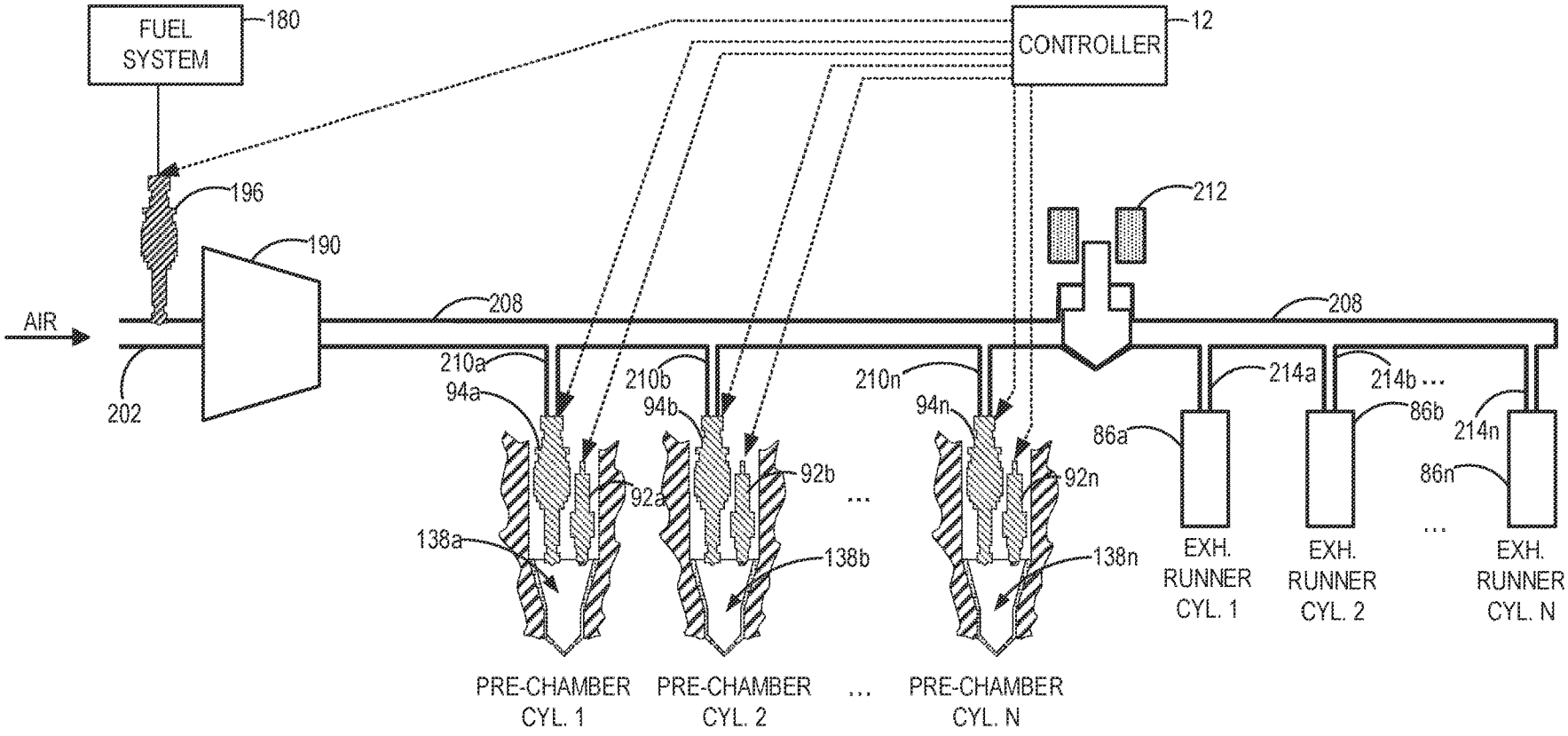
FIG. 2A shows a schematic depiction of an exemplary extended turbulent jet ignition system in a first operating mode.

Reference will now be made to different operating modes of extended TJI system 200 illustrated in FIGS. 2A-2D. Turning first to FIG. 2A, extended TJI system 200 is illustrated in an ignition mode. In the ignition mode, extended TJI system 200 is operated to initiate combustion in each cylinder via the corresponding pre-chamber 138*a*, 138*b*, or 138*n*. For example, controller 12 operates pre-chamber fuel injector 196 to deliver fuel upstream of compressor 190, thus providing an air-fuel mixture to each pre-chamber injector 94*a*, 94*b*, and 94*n* via the corresponding port 210*a*, 210*b*, and 210*n*, respectively. Further, valve 212 is maintained fully closed so that the air-fuel mixture is not provided to exhaust runners 86*a*, 86*b*, and 86*n* via ports 214*a*, 214*b*, and 214*n*, respectively. Each pre-chamber injector 94*a*, 94*b*, and 94*n* is actuated open via controller 12 at an appropriate time during an engine cycle, such as during a compression stroke of the corresponding cylinder, to inject the air-fuel mixture into the corresponding pre-chamber. The air-fuel mixture in the pre-chamber is then ignited via the corresponding pre-chamber spark plug 92*a*, 92*b*, or 92*n* to generate an ignition spark at a desired pre-chamber spark timing. Operating in the ignition mode will be further described below with reference to FIGS. 3 and 4.

Figure 2B:
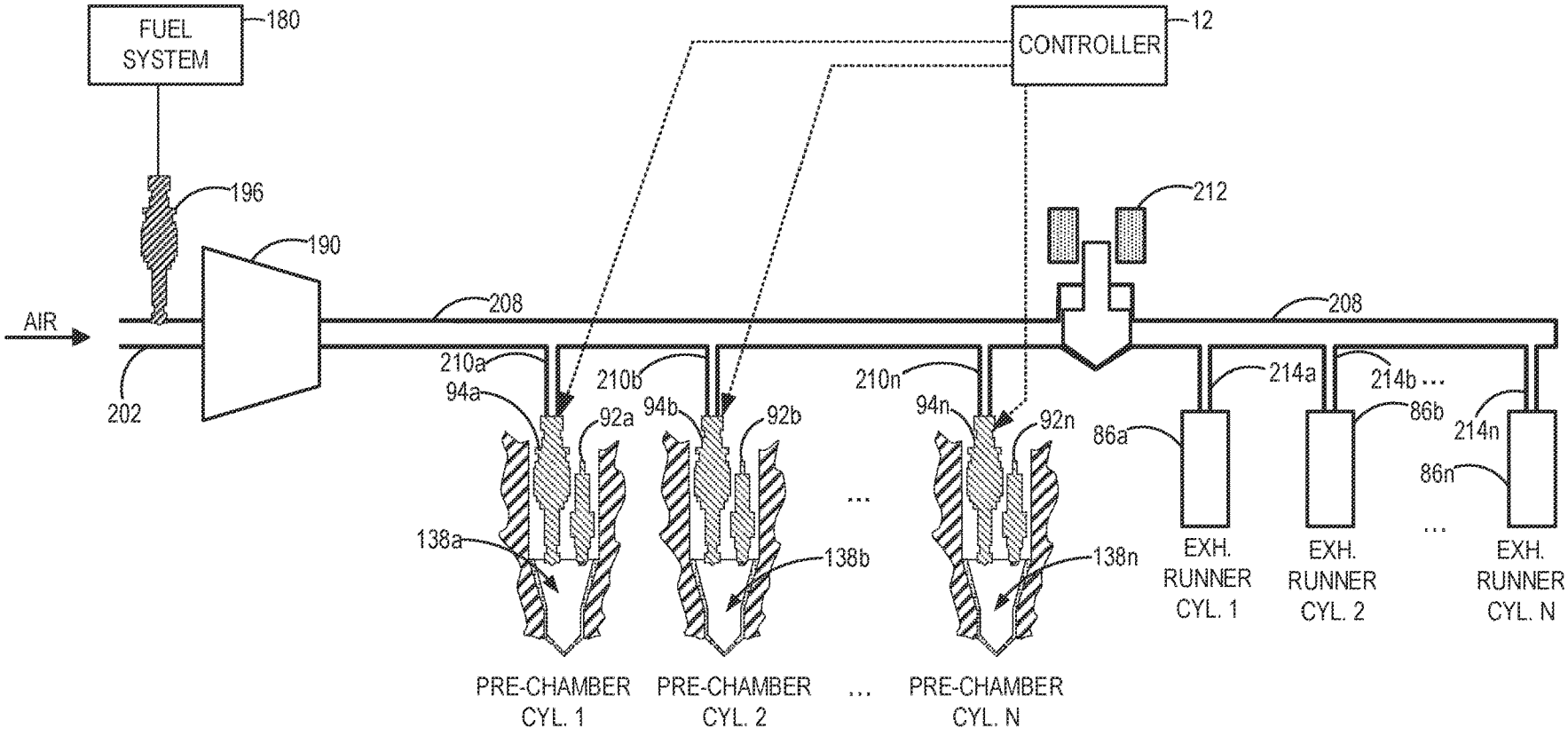
FIG. 2B shows a schematic depiction of the exemplary extended turbulent jet ignition system in a second operating mode.

Referring now to FIG. 2B, extended TJI system 200 is illustrated in an in-cylinder thermactor mode. In the in-cylinder thermactor mode, extended TJI system 200 is operated to provide a secondary air injection in each cylinder via the corresponding pre-chamber 138*a*, 138*b*, or 138*n*. Thus, each pre-chamber provides a first secondary air introduction location that is coupled to each cylinder. As used herein, the term "secondary air" refers to air that is provided to the engine that is not inducted via an intake valve (e.g., intake valve 4 shown in FIG. 1) and is not used for producing torque via combustion. In contrast, air inducted into the engine via the intake valve and used to produce torque via combustion may be referred to as "primary air." For example, to operate extended TJI system 200 in the in-cylinder thermactor mode, controller 12 disables pre-chamber fuel injector 196 so that fuel is not delivered upstream of compressor 190, thus providing only air to each pre-chamber injector 94*a*, 94*b*, and 94*n* via the corresponding port 210*a*, 210*b*, and 210*n*, respectively. Further, valve 212 is maintained fully closed so that the air is not provided to exhaust runners 86*a*, 86*b*, and 86*n* via ports 214*a*, 214*b*, and 214*n*, respectively. Each pre-chamber injector 94*a*, 94*b*, and 94*n* is actuated open via controller 12 at an appropriate time during an engine cycle, such as during an expansion stroke and/or an exhaust stroke of the corresponding cylinder, to inject the air into the corresponding pre-chamber. The injected air oxidizes unburned hydrocarbons within the corresponding cylinder. Because the pre-chamber is not being used to provide ignition, pre-chamber spark plugs 92*a*, 92*b*, or 92*n* are disabled and/or deactivated. Operating in the in-cylinder thermactor mode will be further described below with reference to FIGS. 3 and 5.

Figure 2C:
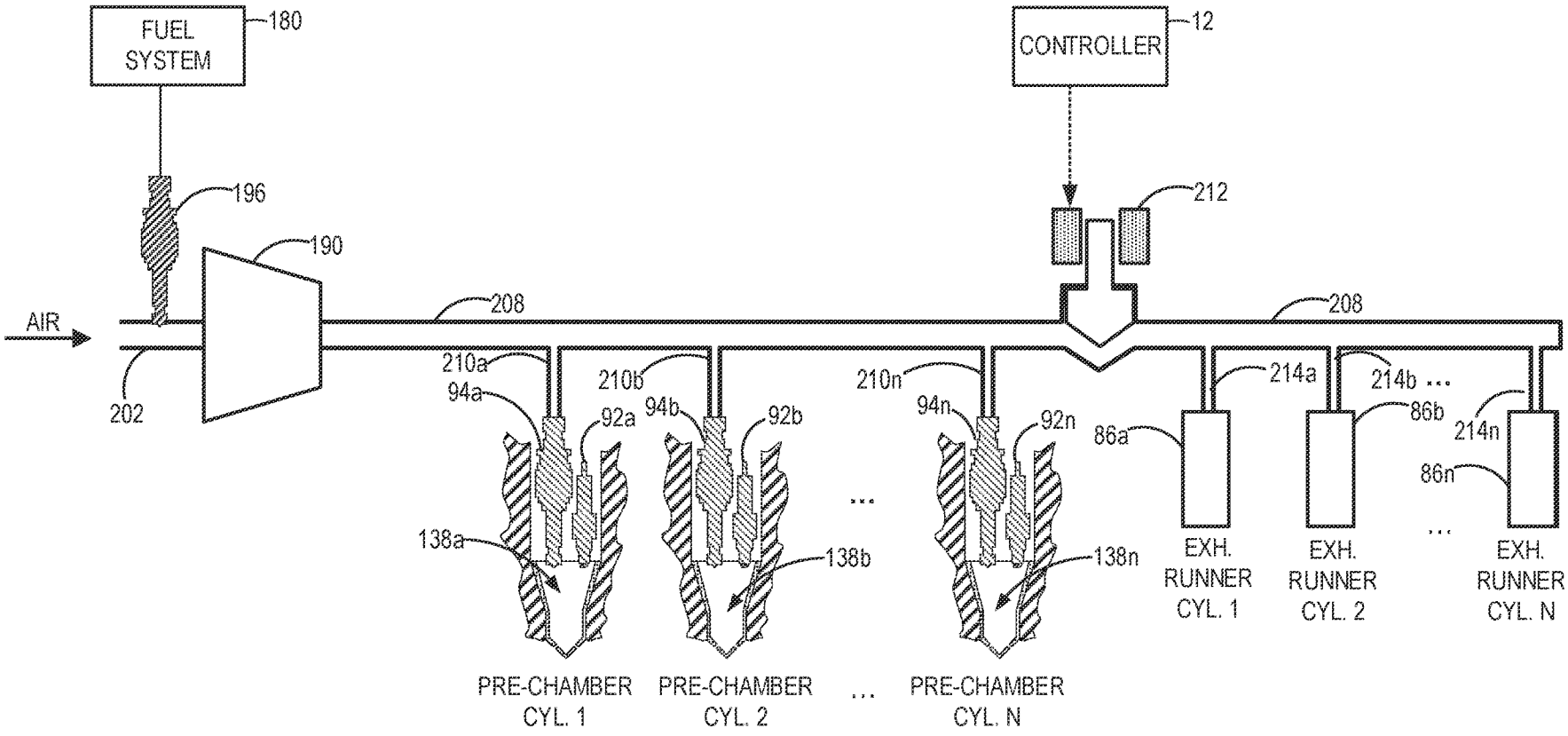
FIG. 2C shows a schematic depiction the exemplary extended turbulent jet ignition system in a third operating mode.

FIG. 2C shows extended TJI system 200 in an exhaust runner thermactor mode. In the exhaust runner thermactor mode, extended TJI system 200 is operated to provide secondary air directly to the exhaust runner of each cylinder via ports 214*a*, 214*b*, and 214*n*. Thus, each exhaust runner provides a second secondary air introduction location that is coupled to each cylinder. For example, to operate extended TJI system 200 in the exhaust runner thermactor mode, controller 12 disables pre-chamber fuel injector 196 so that fuel is not delivered upstream of compressor 190, and valve 212 is fully (or nearly fully) opened to enable the pressurized air from compressor 190 to flow to exhaust runners 86*a*, 86*b*, and 86*n* via the corresponding ports 214*a*, 214*b*, and 214*n*, respectively. Each pre-chamber injector 94*a*, 94*b*, and 94*n* is maintained closed (e.g., is disabled), and pre-chamber spark plugs 92*a*, 92*b*, or 92*n* are disabled and/or deactivated. The pressurized air provided to exhaust runners 86*a*, 86*b*, and 86*n* reacts with and oxidizes unburned hydrocarbons within the corresponding exhaust runner. Operating in the exhaust runner thermactor mode will be further described below with reference to FIGS. 3 and 6.

Figure 2D:
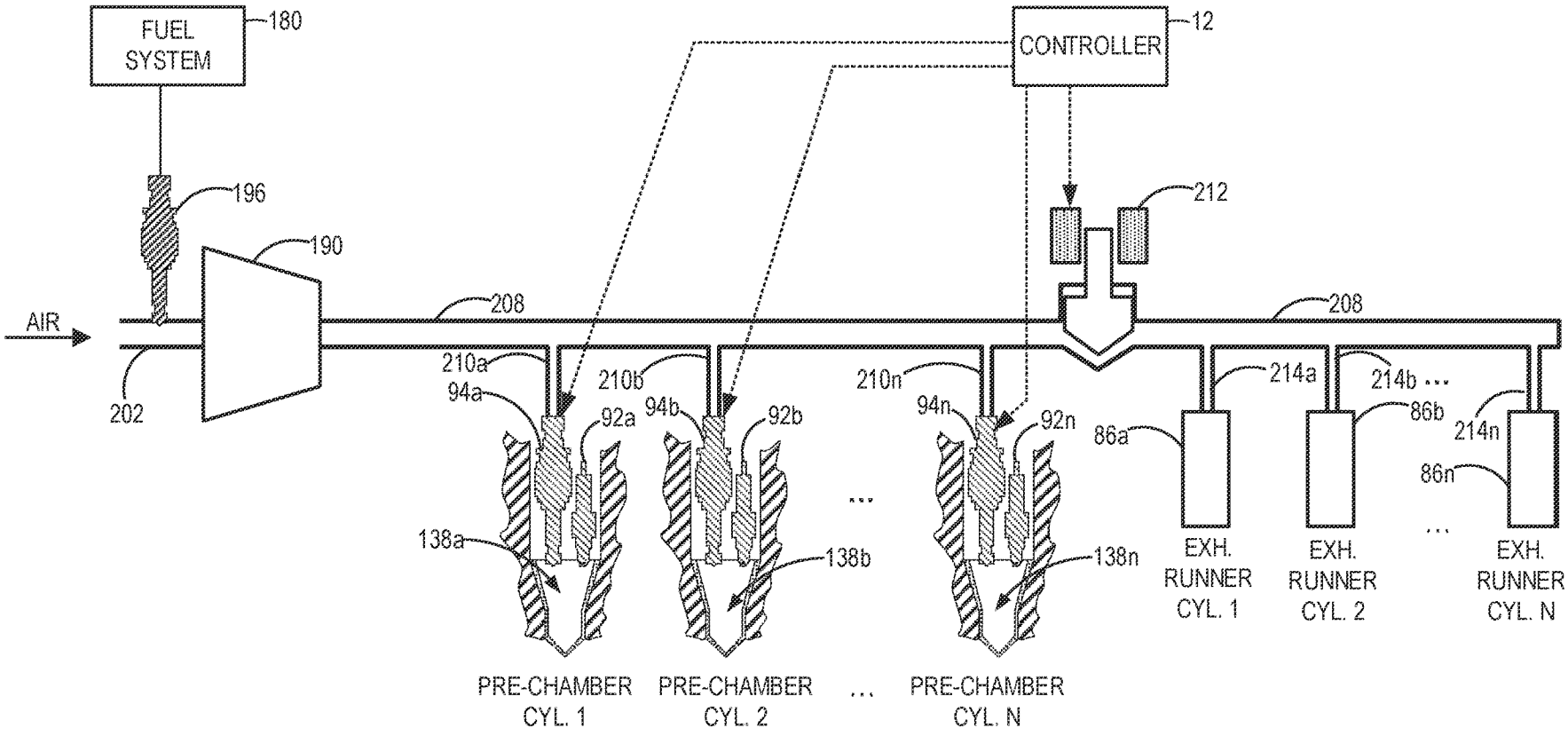
FIG. 2D shows a schematic depiction of the exemplary extended turbulent jet ignition system in a fourth operating mode.

FIG. 2D shows extended TJI system 200 in a combined thermactor mode. In the combined thermactor mode, extended TJI system 200 is operated to provide secondary air injection to each cylinder via pre-chambers 138*a*, 138*b*, and 138*n* and directly to the exhaust runner of each cylinder via ports 214*a*, 214*b*, and 214*n*. Thus, secondary air is provided at two secondary air introduction locations. For example, to operate extended TJI system 200 in the combined thermactor mode, controller 12 disables pre-chamber fuel injector 196 so that fuel is not delivered upstream of compressor 190, and valve 212 is partially opened to enable the pressurized air from compressor 190 to flow to exhaust runners 86*a*, 86*b*, and 86*n* via the corresponding ports 214*a*, 214*b*, and 214*n*, respectively. Each pre-chamber injector 94*a*, 94*b*, and 94*n* is actuated open via controller 12 at an appropriate time during an engine cycle, such as during an expansion stroke and/or an exhaust stroke of the corresponding cylinder, to inject the air into the corresponding pre-chamber. The injected air oxidizes unburned hydrocarbons within the corresponding cylinder, while the air delivered to each exhaust runner reacts with additional unburnt hydrocarbons within the exhaust runner. Further, pre-chamber spark plugs 92*a*, 92*b*, or 92*n* are disabled and/or deactivated. Operating in the combined thermactor mode will be further described below with reference to FIGS. 3 and 7.

Figure 3:
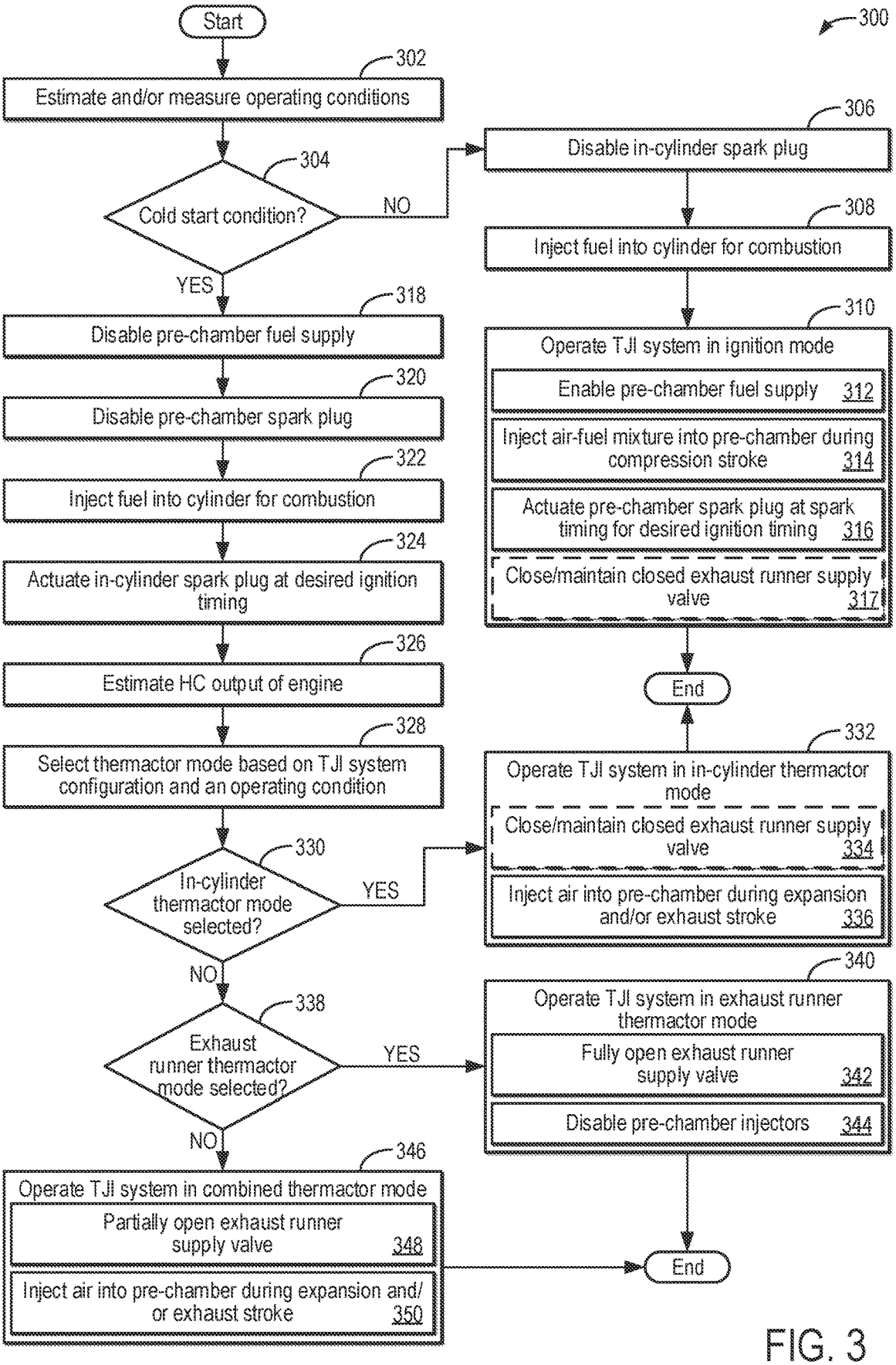
FIG. 3 is a flow chart of an example method for operating a turbulent jet ignition system.

Turning now to FIG. 3, an example method 300 for operating a turbulent jet ignition (TJI) system is shown. For example, the TJI system may be TJI system 195 shown in FIG. 1 or extended TJI system 200 shown in FIGS. 2A-2D, which are each configured to provide pre-chamber ignition or secondary air introduction to the cylinder, depending on an operating mode. Although method 300 will be described with respect to the engine system and components shown in FIGS. 1 and 2A-2D, method 300 may be applied to other engine systems that include a TJI system without parting from the scope of this disclosure. Further, method 300 will be described for one pre-chamber and cylinder pair (e.g., one pre-chamber and the corresponding cylinder it is coupled to), although it may be understood that method 300 may be simultaneously and/or sequentially executed for every cylinder of the engine. Instructions for carrying out method may be executed by a controller (e.g., controller 12 of FIGS. 1 and 2A-2D) based on instructions stored on a memory of the controller and in conjunction with signals received from sensors of the engine system, such as the sensors described above with reference to FIG. 1 and elaborated below. The controller may employ actuators of the engine system to adjust engine operation, such as by adjusting operation of pre-chamber injector 94 and pre-chamber fuel injector 196 of FIGS. 1 and 2A-2D, according to the method described below.

At 302, method 300 includes estimating and/or measuring operating conditions. The operating conditions may include, for example, an engine speed, an intake manifold pressure (e.g., MAP), a mass air flow of intake air provided to the engine (e.g., MAF), an engine temperature, an engine torque demand, an exhaust gas temperature, a commanded engine AFR, a measured engine AFR, an engine dilution, an accelerator pedal position, a brake pedal position, etc. As one example, the exhaust gas temperature may be measured by the exhaust gas temperature sensor, such as temperature sensor 158 of FIG. 1, and may be used to infer a temperature of a catalyst (e.g., emission control device 178 of FIG. 1). As another example, the measured AFR may be determined based on output from an exhaust gas oxygen sensor (e.g., exhaust gas sensor 128 of FIG. 1). The intake manifold pressure may be measured by a MAP sensor, such as MAP sensor 122 of FIG. 1, and the inducted mass air flow may be measured by a MAF sensor, such as MAF sensor 123 of FIG. 1. As still another example, the engine temperature may be determined from an output of an engine coolant temperature sensor, such as ECT sensor 112 of FIG. 1. As yet another example, the engine dilution may be determined based on a position of an EGR valve, such as EGR valve 80 of FIG. 1. Further, the accelerator pedal position may be measured by an accelerator pedal position sensor, such as accelerator pedal position sensor 118 of FIG. 1, and the brake pedal position may be measured by a brake pedal position sensor, such as brake pedal position sensor 119 of FIG. 1. Together, the accelerator pedal position and the brake pedal position may indicate a demanded amount of engine torque.

At 304, it is determined if a cold start condition is present. As an example, the cold start may be confirmed when the engine temperature is less than a first threshold temperature. The first threshold temperature may correspond to a non-zero, positive temperature value stored in a memory of the controller, above which the engine is considered to be warm and at a steady state operating temperature. As another example, the cold start may be confirmed when the engine temperature is substantially equal to ambient temperature (e.g., within a threshold of the ambient temperature, such as within 10° C.) at engine start (e.g., when the engine cranked from zero speed to a non-zero speed, with fuel and spark provided to initiated combustion). As still another example, the cold start may be confirmed when the engine has been inactive for greater than a threshold duration, which may correspond to a non-zero amount of time (e.g., minutes, hours, or days) over which the engine is expected to cool to approximately ambient temperature.

Additionally or alternatively, the cold start condition may be confirmed when the temperature of the catalyst is less than a desired operating temperature. As one example, the desired operating temperature may be a light-off temperature of the catalyst. The light-off temperature of the catalyst may be a predetermined, second threshold temperature stored in the memory of the controller at or above which a high catalytic efficiency is achieved, enabling the catalyst to effectively decrease vehicle emissions, for example. The catalyst may be below its light-off temperature when the engine temperature is less than the first threshold temperature, for example, and thus, heating of the catalyst may be requested during the cold start condition.

If the cold start condition is not present, method 300 proceeds to 306 and includes disabling an in-cylinder spark plug. For example, the in-cylinder spark plug may be main chamber spark plug 93 of FIG. 1. Disabling the in-cylinder spark plug may include the in-cylinder spark plug no longer receiving a spark advance signal from the controller (e.g., spark advance signal SA shown in FIG. 1), and, as a result, the in-cylinder spark plug does not create a spark to ignite gases within the cylinder. Instead of ignition within the cylinder, ignition may occur via the pre-chamber of the TR system, which will be described below at 316.

At 308, method 300 includes injecting fuel into the cylinder for combustion. Fuel may be injected, for example, by a fuel injector (e.g., fuel injector 66 of FIG. 1) that receives a fuel pulse-width signal (e.g., FPW1 from FIG. 1) from the controller. As an example, fuel may be directly injected into the cylinder by the fuel injector during a compression stroke of the cylinder via one or more injections. Additionally or alternatively, fuel may be directly injected into the cylinder during an intake stroke of the cylinder. In still other examples, port fuel injection may be used in addition to or as an alternative to direct injection.

The controller may determine a total amount of fuel to inject into the cylinder during an engine cycle based on an amount (e.g., mass) of primary air inducted into the cylinder, also referred to herein as a cylinder air charge, and a desired AFR. As one example, the desired AFR may be stoichiometry. The controller may input the cylinder air charge and the desired AFR into a look-up table, algorithm, or map stored in a memory of the controller, which may output the total amount of fuel to inject into the cylinder. Further, the controller may determine the timing of the fuel injection(s) based on a plurality of engine operating conditions, such as the engine speed, the engine temperature, and the engine load. The controller may input the plurality of engine operating conditions (e.g., the engine speed, the engine temperature, and the engine load) into another look-up table, algorithm, or map stored in the memory of the controller, which may output the timing (e.g., a start of injection timing) for each of the fuel injection(s). When multiple injections are used, the output may further include a fraction of the total amount of fuel to deliver via each injection. The controller may then adjust and transmit the fuel pulse-width signal to the cylinder fuel injector to inject the determined amount of fuel at the determined timing(s).

At 310, method 300 includes operating the TJI system in an ignition mode. An example of operating TJI system in the ignition mode is shown in FIG. 2A. When the TJI system is operated in the ignition mode, the TJI system initiates combustion in the cylinder using the pre-chamber and is not used as a thermactor, as will be elaborated below.

Operating the TJI system in the ignition mode includes enabling a pre-chamber fuel supply, as indicated at 312. For example, the controller operates a pre-chamber fuel injector (e.g., pre-chamber fuel injector 196 of FIGS. 1 and 2A-2D) to deliver fuel upstream of a compressor (e.g., compressor 190 shown in FIG. 1), thus providing an air-fuel mixture to the pre-chamber. For example, the pre-chamber fuel injector may receive a fuel pulse-width signal (e.g., FPW2 from FIG. 1) from the controller and inject fuel directly into an air intake passage according to the pulse-width of the signal. As one example, the controller may determine the pulse-width and the timing(s) of the fuel pulse-width signal based on, for example, an air pressure and/or mass flow rate provided by the compressor and a desired AFR for operating the pre-chamber. The desired AFR for operating the pre-chamber may be the same or different than the desired AFR of the cylinder. For example, the desired AFR for operating the pre-chamber may be stoichiometry. The controller may input the desired AFR for operating the pre-chamber and the air pressure and/or mass flow rate provided by the compressor into a look-up table, algorithm, or map stored in the memory of the controller, which may output the pulse-width and the timing(s) of the fuel pulse-width signal to send to the pre-chamber fuel injector. The controller may then generate and transmit the fuel pulse-width signal to the pre-chamber fuel injector at the determined timing(s). Thus, the pre-chamber fuel injector may supply the fuel to the pre-chamber (and every other pre-chamber of the TJI system), and the fuel provided by pre-chamber fuel injector may mix with the air provided by the compressor before being delivered to the pre-chamber injector via a common delivery passage (e.g., common delivery passage 208 of FIGS. 2A-2D).

Operating the TJI system in the ignition mode further includes injecting the air-fuel mixture into the pre-chamber during the compression stroke, as indicated at 314. For example, the pre-chamber injector receives the air-fuel mixture from the common delivery passage via a port and is actuated open by the controller during the compression stroke of the cylinder to inject the air-fuel mixture into the pre-chamber. For example, the pre-chamber injector may be opened according to an injector pulse-width signal received from the controller (e.g., signal IPW shown in FIG. 1). As one example, the controller may determine a timing and/or pulse-width of the injector pulse-width signal based on one or more operating conditions (e.g., engine speed and engine load), such as by inputting the one or more operating conditions into a look-up table, algorithm, or map stored in memory. The look-up table, algorithm, and/or map may output the timing and/or pulse-width of the injector pulse-width signal, and the controller may generate and transmit the injector pulse-width signal at the determined timing. In some examples, injecting the air-fuel mixture into the pre-chamber may purge gases introduced from the cylinder and remaining in the pre-chamber from a previous combustion cycle while also providing the air-fuel mixture for combustion in the pre-chamber. In other examples, multiple injections may be performed, such as to purge the pre-chamber via a first injection and to provide the air-fuel mixture for combustion via a second injection.

Operating the TJI system in the ignition mode further includes actuating a pre-chamber spark plug at a desired ignition timing, as indicated at 316. For example, the pre-chamber spark plug may be pre-chamber spark plug 92 shown in FIG. 1. The desired ignition timing refers to when to ignite the air-fuel mixture in the pre-chamber relative to a position of a piston in the cylinder. The desired ignition timing may be determined based on the demanded amount of engine torque, for example. For example, the desired ignition timing may be adjusted relative to the ignition timing for maximum brake torque (MBT) based on engine operating conditions. For example, the desired ignition timing may be advanced closer to MBT timing to increase a torque output of the cylinder. In one example, the controller may input one or more engine operating conditions (e.g., the demanded amount of engine torque, the engine speed, the engine load, the exhaust gas temperature, the desired pre-chamber AFR, and the desired cylinder AFR) into one or more look-up tables, functions, or maps to determine the desired ignition timing. In another example, the controller may make a logical determination (e.g., regarding the desired ignition timing) based on logic rules that are a function of the one or more engine operating conditions, including the demanded amount of engine torque. Further, it may be understood that the desired ignition timing may be later when the TJI system is operated in the ignition mode relative to when direct in-cylinder spark ignition is used for a same combustion phasing due to a faster burn rate produced via the TJI system.

To generate the ignition spark in the pre-chamber at the desired ignition timing, the controller may generate a control signal (e.g., signal SA) that is sent to an ignition system (e.g., ignition system 88 of FIGS. 1 and 2A-2D) to actuate the pre-chamber spark plug at the desired ignition timing. When the pre-chamber spark plug provides the ignition spark to the pre-chamber, the air-fuel mixture within the pre-chamber may combust, with the increased pressure of combustion sending jets of flame and hot gases into the cylinder through a plurality of openings (e.g., the plurality of openings 142 shown in FIG. 1). The jets of flame may ignite the air-fuel mixture in the cylinder, resulting in a combustion reaction within the cylinder that produces torque.

In some examples, operating the TJI system in the ignition mode includes closing or maintaining closed an exhaust runner supply valve, as optionally indicated at 317. When included, the exhaust runner supply valve (e.g., valve 212 of FIGS. 2A-2D) enables flow between the common delivery passage and an exhaust runner of the cylinder when at least partially open and blocks flow between the common delivery passage and the exhaust runner when closed. Thus, when the TJI system includes plumbing to the exhaust runner and the exhaust runner supply valve, such as in the extended TJI system shown in FIGS. 2A-2D, the exhaust runner supply valve is actuated closed (if open) or maintained fully closed (if already closed) while the TJI system is operated in the ignition mode. For example, the controller may de-energize the exhaust runner supply valve to close the exhaust runner supply valve and may not energize the exhaust runner supply valve while operating the TJI system in the ignition mode. In this way, the TJI system may be used to inject and ignite the air-fuel mixture in the pre-chamber for pre-chamber ignition and may not provide secondary air to the exhaust runner of the cylinder.

Method 300 may then end. For example, method 300 may be repeated at a pre-determined frequency during engine operation to provide robust pre-chamber ignition to the cylinder across a variety of operating conditions.

Returning to 304, if the cold start condition is present, method 300 proceeds to 318 and includes disabling the pre-chamber fuel supply, such as by disabling or deactivating the pre-chamber fuel injector. When the pre-chamber fuel injector is disabled, the pre-chamber fuel injector stops receiving the fuel pulse-width signal from the controller. As such, the pre-chamber fuel injector will not open and will not inject fuel into the air intake passage upstream of the compressor. As a result, the compressor will supply air to the common delivery passage and not an air-fuel mixture.

At 320, method 300 includes disabling the pre-chamber spark plug. Since the pre-chamber is not being supplied with fuel, the pre-chamber spark plug will not have an air-fuel mixture to ignite with a spark. To disable the pre-chamber spark plug, the controller may not send the spark advance signal to the pre-chamber spark plug, for example. As a result, the pre-chamber spark plug does not generate a spark in the pre-chamber, and combustion does not occur within the pre-chamber. Thus, the pre-chamber (and the TR system) is not used for ignition.

At 322, method 300 includes injecting fuel into the cylinder for combustion. Fuel may be injected, for example by the fuel injector coupled to the cylinder in response to the fuel pulse-width signal received from the controller. Similar to method 300 at 308, the fuel may be injected into the cylinder during the intake stroke and/or the compression stroke via one or more injections. In some examples, the desired AFR of the cylinder may be different than when the cold start condition is not present (e.g., at 308). As one example, the AFR may be richer during the cold start condition.

At 324, method 300 includes actuating the in-cylinder spark plug at the desired ignition timing. The in-cylinder spark plug may provide a spark to the cylinder in response to the spark advance signal from the controller. The controller may determine the desired ignition timing similar to the manner described above at 316, for example, and actuate the in-cylinder spark plug at the desired ignition timing. However, the desired ignition timing may be different during the cold start compared to when the cold start condition is not present. For example, combustion phasing may be very late (e.g., compared to when the cold start condition is not present, as at 316) to provide more heat to the catalyst as exhaust waste heat. The late combustion phasing means that flame propagation within the cylinder may occur while the cylinder is expanding. As one example, the desired ignition timing may be during an expansion stroke. Further, the desired ignition timing may be different when the in-cylinder spark plug is used relative to when the pre-chamber spark plug is used for a same combustion phasing. For example, the in-cylinder spark plug may be actuated earlier than the pre-chamber spark plug would be for the same combustion phasing due to the slower burn rate produced via the direct in-cylinder spark ignition. As one non-limiting example, the spark timing for the in-cylinder spark plug may occur further before TDC during the compression stroke while the spark timing for the pre-chamber spark plug may occur closer to TDC during the compression stroke for the same combustion phasing.

At 326, method 300 includes estimating a hydrocarbon output of the engine. As one example, the exhaust gas sensor may be used to estimate the hydrocarbon output of the engine. For example, the controller may input measurements received from the exhaust gas sensor into a look-up table, algorithm, or map stored in memory, which may output the estimated hydrocarbon output of the engine. The hydrocarbon output may be a concentration or mass, for example. Additionally or alternatively, the controller may estimate the hydrocarbon output of the engine based on one or more engine operating conditions, such as the engine temperature, a number of engine cycles or a duration since engine start, a fuel injection timing and amount, etc. For example, the controller may input the one or more engine operating conditions (e.g., the engine temperature, the number of engine cycles since engine start or the duration since the engine start, the fuel injection timing and amount) into a look-up table, algorithm, or map stored in memory, which may output the estimated hydrocarbon output of the engine. In particular, the hydrocarbon output of the engine may peak during the first several firing events of the engine and then begin to decrease. In still other examples, the controller may determine the hydrocarbon output of the engine from an output of a hydrocarbon sensor positioned, for example, in an exhaust manifold of the engine.

At 328, method 300 includes selecting a thermactor mode based on the TJI system configuration and an operating condition. In particular, the controller may determine if the TJI system is the extended configuration that includes additional plumbing to the exhaust runner or the non-extended configuration that only provides air or air and fuel to the pre-chamber. In one example, the controller may automatically determine the TJI system configuration based on known TJI system components and/or pre-programmed instructions stored into the memory of the controller. Further, the extended configuration may enable the controller to select between an in-cylinder thermactor mode, an exhaust runner thermactor mode, and a combined thermactor mode, whereas the non-extended configuration may enable the controller to only select the in-cylinder thermactor mode.

Therefore, if the TJI system is in the extended configuration, the controller may select between the in-cylinder thermactor mode, the exhaust runner thermactor mode, and the combined thermactor mode based on the operating condition. In some examples, the operating condition may include the estimated hydrocarbon output of the engine. Further, the operating condition may be one of a first operating condition, a second operating condition, and a third operating condition. The first operating condition may include the hydrocarbon output of the engine being greater than a first, upper threshold. The second operating condition may include the hydrocarbon output of the engine being less than the upper threshold and greater than a second, lower threshold. The third operating condition may include the hydrocarbon output of the engine being less than the lower threshold. The first, upper threshold may be a non-zero, positive hydrocarbon amount (e.g., concentration or mass) above which supplying secondary air injection to one location (e.g., either the cylinder or the exhaust runner) may not efficiently neutralize the hydrocarbons in the feedgas provided to the catalyst. The second threshold may be a non-zero, positive hydrocarbon amount (e.g., concentration or mass) that is less than the first threshold and above which supplying secondary air injection to the exhaust runner may be more efficient for oxidizing hydrocarbons than air injection via the pre-chamber and below which the air injection may more precisely deliver a desired amount of air for oxidizing the hydrocarbons. For example, when the hydrocarbon output is less than the second threshold, supplying secondary air to the exhaust runner may result in excess oxygen in the exhaust gas.

As one example, the combined thermactor mode may be the most efficient at oxidizing unburnt hydrocarbons because secondary air is provided to two locations (the cylinder via the pre-chamber and the exhaust runner). Therefore, if the estimated hydrocarbon output is high (e.g., higher than the first, upper threshold), the first operating condition may be present, and the controller may select the combined thermactor mode responsive to the first operating condition. As another example, if the estimated hydrocarbon output is lower than the first threshold and greater than the second, lower threshold, the second operating condition may be present. Responsive to the second operating condition, the controller may select the exhaust runner thermactor mode. If the estimated hydrocarbon output is less that the second threshold, the third operating condition may be present. In response to the third operating condition, the controller may select the in-cylinder thermactor mode.

Additionally or alternatively, the operating condition may include the number of engine cycles since the engine start or the duration since the engine start. As such, the first operating condition may additionally or alternatively include the duration since the engine start being less than a first threshold duration (or the number of engine cycles since the engine start being less than a first threshold number of engine cycles), the second operating condition may additionally or alternatively include the duration since the engine start being greater than the first threshold duration and less than a second threshold duration (or the number of engine cycles since the engine start being greater than the first threshold number of engine cycles and less than a second number of engine cycles), and the third operating condition may additionally or alternatively include the duration since the engine start being greater than the second threshold duration (or the number of engine cycles since the engine start being greater than the second threshold number of engine cycles). As an example, the first threshold duration or the first threshold number of engine cycles may correspond to a period over which the hydrocarbon output of the engine peaks, after which providing secondary air to two locations (e.g., via the combined thermactor mode) may promote cooling of the exhaust gas while not increasing hydrocarbon oxidation efficiency. Similarly, the second threshold duration or the second threshold number of engine cycles may correspond to a period after which in-cylinder air injection is the most efficient for oxidizing unburnt hydrocarbons while reducing (e.g., minimizing) unreacted oxygen in the exhaust gas.

As noted above, the hydrocarbon output of the engine may peak during the first several firing events. Therefore, in anticipation of the high hydrocarbon output of the engine in the first several firing events, the controller may be programmed to initially select the combined thermactor mode responsive to the cold start condition being confirmed at engine start (e.g., when the engine is cranked to a non-zero speed from rest and combustion is commenced), which occurs while or during the first operating condition. Then, after operating in the combined thermactor mode for the first threshold number of engine cycles or the first threshold duration, the second operating condition is present, and the controller may select the exhaust runner thermactor mode in response thereto. After operating in the exhaust runner thermactor mode for the second threshold duration or the second threshold number of engine cycles, the third operating condition is present, and the controller may select the in-cylinder thermactor mode in response thereto. Alternatively, the controller may more gradually adjust the TJI system between the three thermactor operating modes, as will be elaborated below.

At 330, method 300 includes determining if the in-cylinder thermactor mode is selected, such as when only the in-cylinder thermactor mode is available and/or when the third operating condition is present. If the in-cylinder thermactor mode is selected, method 300 proceeds to 332 and includes operating the TJI system in the in-cylinder thermactor mode.

In some examples, operating the TJI system in the in-cylinder thermactor mode includes closing or maintaining closed the exhaust runner supply valve, as optionally indicated at 334. When included, the exhaust runner supply valve is actuated closed if the exhaust runner supply valve is open. If the exhaust runner supply valve is already closed, then the exhaust runner supply valve is maintained fully closed. When the exhaust runner supply valve is maintained fully closed, air from the TJI system is not provided to the exhaust runner of the cylinder. In examples where the TJI system does not include the exhaust runner supply valve, 334 may be omitted.

Operating the TJI system in the in-cylinder thermactor mode further includes injecting air into the pre-chamber during an expansion and/or exhaust stroke of the cylinder, as indicated at 336. The pre-chamber injector is actuated open by the controller to inject air into the pre-chamber at a timing determined based on a temperature in the cylinder, for example. The temperature of the cylinder may fluctuate throughout the engine cycle, with peak combustion temperatures occurring following ignition as the flame propagates through the cylinder. Therefore, the air is injected late in the expansion and/or exhaust stroke because the temperature in the cylinder is high enough for hydrocarbon oxidation, but the temperature is not excessively high for NOx formation. As one example, the temperature in the cylinder may be inferred based on the ignition timing, and the controller may input the ignition timing into a look-up table, algorithm, or map stored in memory, which may output an air injection timing for injecting the secondary air into the pre-chamber. The air injection timing may be further adjusted based on an in-cylinder pressure and a pressure of the air delivery passage, particularly when the injection is performed in the expansion stroke. For example, the in-cylinder pressure fluctuates throughout an engine cycle and may be higher earlier in the expansion stroke and lower later in the expansion stroke. The air injection timing may be programmed to occur while the pressure in the air delivery passage is at least a threshold amount higher than the in-cylinder pressure, with the threshold amount corresponding to a non-zero, positive amount of pressure that is calibrated to prevent back flow and to provide desired mixing characteristics. Thus, the air injection timing may only occur while the pressure in the air delivery passage is at least the threshold amount greater than the in-cylinder pressure, at least in some examples.

Further, the controller may adjust the amount of air injected based on the estimated hydrocarbon output of the engine, such as by increasing the amount of air injected as the estimated hydrocarbon output of the engine increases and decreasing the amount of air injected as the estimated hydrocarbon output of the engine decreases. The controller may adjust the pulse-width of the IPW signal accordingly and transmit the injector pulse-width signal to the pre-chamber injector at the determined air injection timing. The injected air oxidizes unburned hydrocarbons within the corresponding cylinder, thus lowering the hydrocarbon output, and generating additional heat through the exothermic reaction.

Method 300 may then end. For example, method 300 may be repeated at a pre-determined frequency during engine operation to adjust the TJI system operating mode as the operating conditions change in order to effectively reduce hydrocarbon emissions during catalyst heating.

Returning to 330, if the in-cylinder thermactor mode is not selected, method 300 proceeds to 338 and includes determining if the exhaust runner thermactor mode is selected. The exhaust runner thermactor mode may be selected during the second operating condition described above at 328, for example.

If the exhaust runner thermactor mode is selected, method 300 proceeds to 340 and includes operating the TJI system in the exhaust runner thermactor mode. Operating the TJI system in the exhaust runner thermactor mode includes fully (or nearly fully) opening the exhaust runner supply valve, as indicated at 342. For example, the exhaust runner supply valve may be opened to a first, larger degree when the exhaust runner thermactor mode is selected relative to when the combined thermactor mode is selected, as will be described below. To open the exhaust runner supply valve, the valve is energized via a control signal from the controller. When fully open, air is delivered to the exhaust runner of the cylinder via the common delivery passage of the TJI system. By supplying additional, secondary air to the exhaust runner, unburnt hydrocarbons in the exhaust runner may be oxidized to reduce the amount of hydrocarbons in the exhaust gas supplied to the catalyst.

Operating the TJI system in the exhaust runner thermactor mode further includes disabling the pre-chamber injector, as indicated at 344. To disable the pre-chamber injector, the controller discontinues sending the signal IPW. As a result, the pre-chamber injector no longer delivers air to the pre-chamber. Method 300 may then end.

Returning to 338, if the exhaust runner thermactor mode is not selected, it may be determined that the combined thermactor mode is selected, and method 300 proceeds to 346 and includes operating the TJI system in the combined thermactor mode. Operating the TJI system in the combined thermactor mode includes partially opening the exhaust runner supply valve, as indicated at 348. As an example where the exhaust runner supply valve is a solenoid valve, the controller may adjust the exhaust runner supply valve to the partially open position by providing current to solenoid coils of the exhaust runner supply valve. However, an amount of current provided may be less than when the TJI system is operated in the exhaust runner thermactor mode (e.g., as at 342). Thus, the exhaust runner supply valve may be opened to a second, smaller degree when the TJI system is operated in the combined thermactor mode. With the exhaust runner supply valve partially open, pressurized air from the compressor may flow to the exhaust runner. Thus, any unburnt hydrocarbons within the exhaust runner may then be oxidized by the air provided by the TJI system to the exhaust runner via the partially open exhaust runner supply valve.

Operating the TJI system in the combined thermactor mode further includes injecting air into the pre-chamber during the expansion and/or exhaust stroke, as indicated at 350. The pre-chamber injector is actuated open by the controller to inject air in a manner similar to that described above at 336. However, the amount of air injected may be less than when operating in the in-cylinder thermactor mode since secondary air is provided at two secondary air introduction locations (e.g., the cylinder via the pre-chamber and the exhaust runner), at least in some examples. The injected air oxidizes unburned hydrocarbons within the cylinder, while the air delivered to each exhaust runner reacts with additional unburnt hydrocarbons within the exhaust runner.

Additionally or alternatively, the controller may gradually adjust the TJI system between the different operating modes. For example, the TJI system may be initially operated in the combined thermactor mode (e.g., responsive to the first operating condition) and gradually shifted to operating in the in-cylinder thermactor mode by the controller gradually closing the exhaust runner supply valve. In such an example, the controller may adjust the opening of the exhaust runner supply valve as a function of the number of engine cycles (or duration) since the engine start, the estimated or measured hydrocarbon output of the engine, and/or the temperature of the catalyst. For example, the opening (e.g., amount or degree of opening) of the exhaust runner supply valve may generally decrease as one or more of the number of engine cycles, the hydrocarbon output of the engine, and the temperature of the catalyst increases. As another example, the TJI system may be initially operated in the combined thermactor mode and gradually shifted to operating in the exhaust runner thermactor mode by gradually reducing the pre-chamber injector pulse-width. In such an example, the pre-chamber injector pulse-width may be adjusted as a function of the number of engine cycles since the engine start, the estimated or measured hydrocarbon output of the engine, and/or the temperature of the catalyst. For example, the pulse-width of the control signal transmitted to the pre-chamber injector may generally decrease as one or more of the number of engine cycles, the hydrocarbon output of the engine, and the temperature of the catalyst increases.

In yet another example, the TJI system may be initially operated in the exhaust runner thermactor mode and gradually switch to operating in the in-cylinder thermactor mode with the combined thermactor mode serving as an intermediate mode between the exhaust runner thermactor mode and the in-cylinder thermactor mode. In this example, the controller may gradually close the exhaust runner supply valve while simultaneously increasing the pre-chamber injector pulse width. However, in this example, a smaller amount of secondary air may be provided at the engine start compared to when the TJI system is initially operated in the combined thermactor mode at the engine start.

Further, in general, the pre-chamber injector pulse-width and the exhaust runner supply valve opening may follow prescribed profiles (e.g., functions or maps stored in controller memory) that relate the pulse-width or valve opening to the number of engine cycles since start, the hydrocarbon output of the engine, and/or the catalyst temperature, allowing gradual or discrete switches among the three modes. Method 300 may then end.

In this way, the TJI system may be operated to provide ignition or to introduce secondary air based on operating conditions. For example, the TJI system may be operated to provide ignition when a cold start condition is not present in order to provide increased engine efficiency, for example, while the TJI system may be operated to provide secondary air during a cold start condition to reduce an amount of unburnt hydrocarbons provided to the catalyst prior to light-off. Further, when the TJI system is coupled to the exhaust runner, the TJI system may be operated in one of a plurality of different thermactor operating modes in order to more efficiently reduce hydrocarbon emissions. For example, the secondary air may be provided at one or more secondary air introduction locations according to an operating condition (e.g., whether a first, second, or third operating condition is present, as defined above). As a result, vehicle emissions during the cold start may be reduced. For example, a total hydrocarbon output of the vehicle may remain less than a threshold vehicle hydrocarbon output (e.g., a regulatory emissions threshold) during each of the first, second, and third operating conditions due to the oxidation of the hydrocarbons prior to the hydrocarbons reaching the catalyst prior to light-off.

In an alternative example of the method, such as where each pre-chamber has a separate fuel injector coupled thereto, the TJI system may be operated to provide ignition during the compression stroke, as described at 310, and also to provide secondary air during the expansion and/or exhaust strokes, such as described at 332, 340, and 346. Thus, during a single combustion cycle of the cylinder, the TJI system may provide ignition at a first timing during the combustion cycle (e.g., during the compression stroke) and may provide secondary air at a second timing during the combustion cycle (e.g., during the expansion stroke and/or the exhaust stroke). In such example, the in-cylinder spark plug may not be used. Further, the in-cylinder spark plug may be optionally omitted from the engine.

Figure 4:
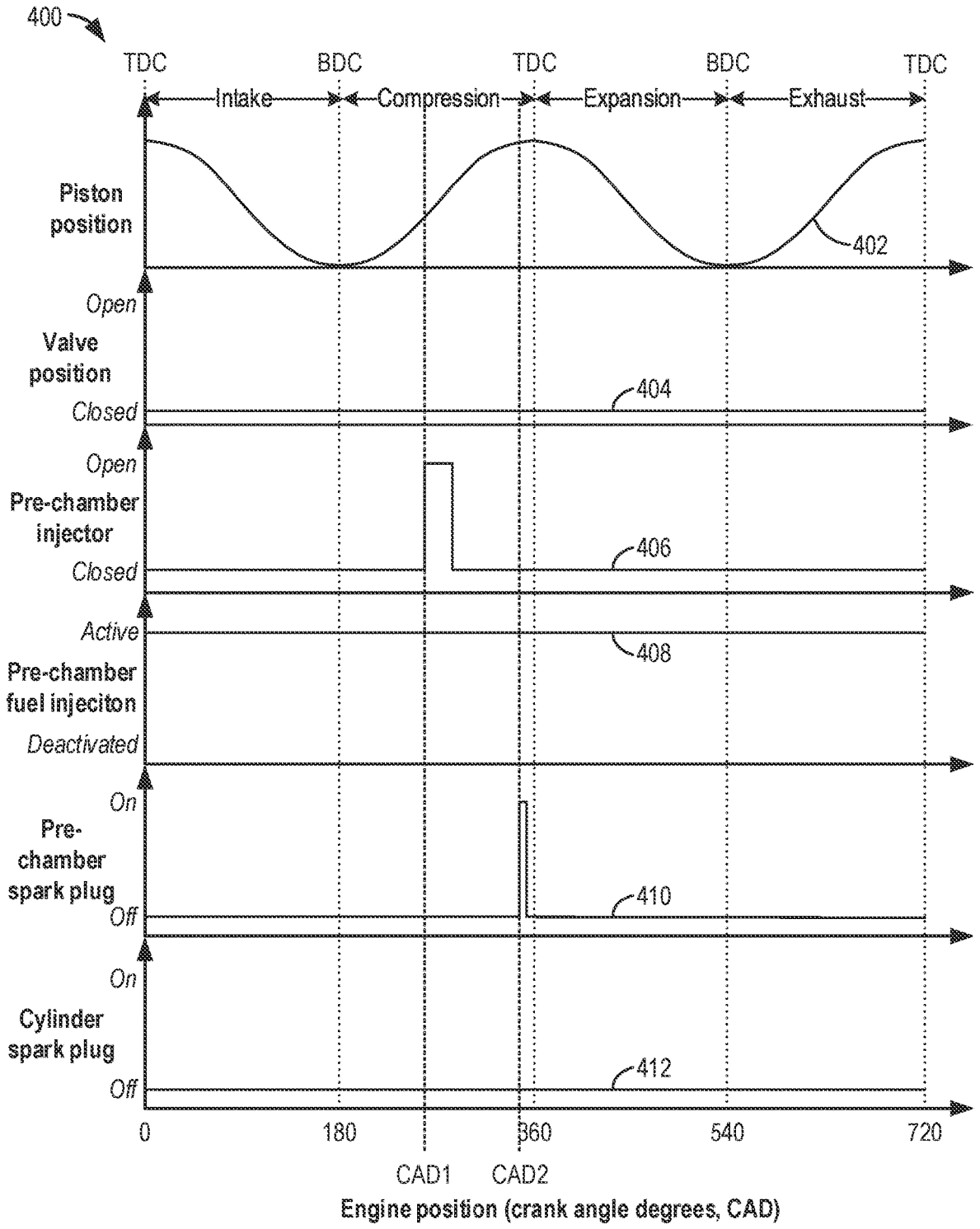
FIG. 4 shows an example timing chart of operating a turbulent jet ignition system in an ignition mode.
Figure 5:
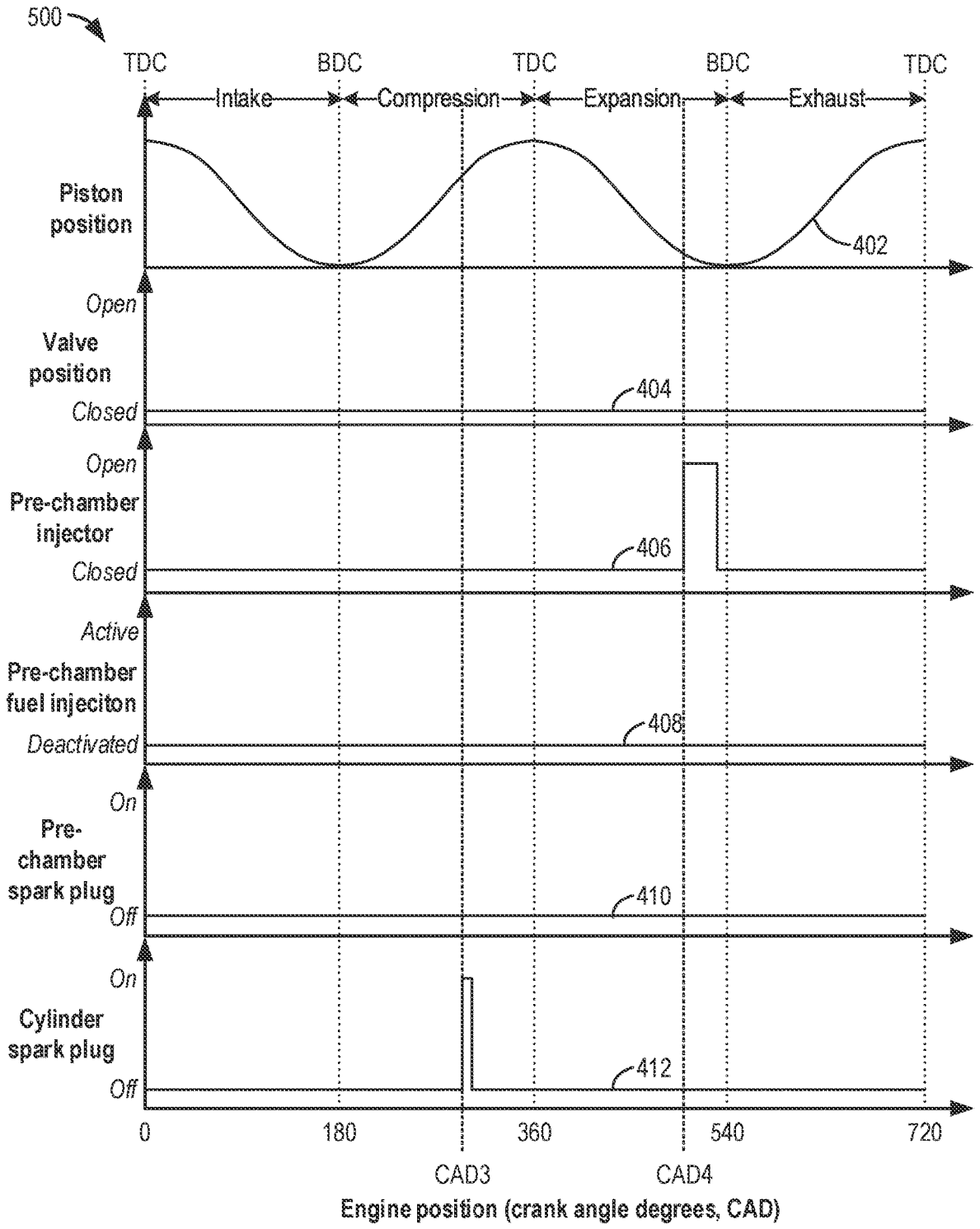
FIG. 5 shows an example timing chart of operating a turbulent jet ignition system in an in-cylinder thermactor mode.
Figure 6:
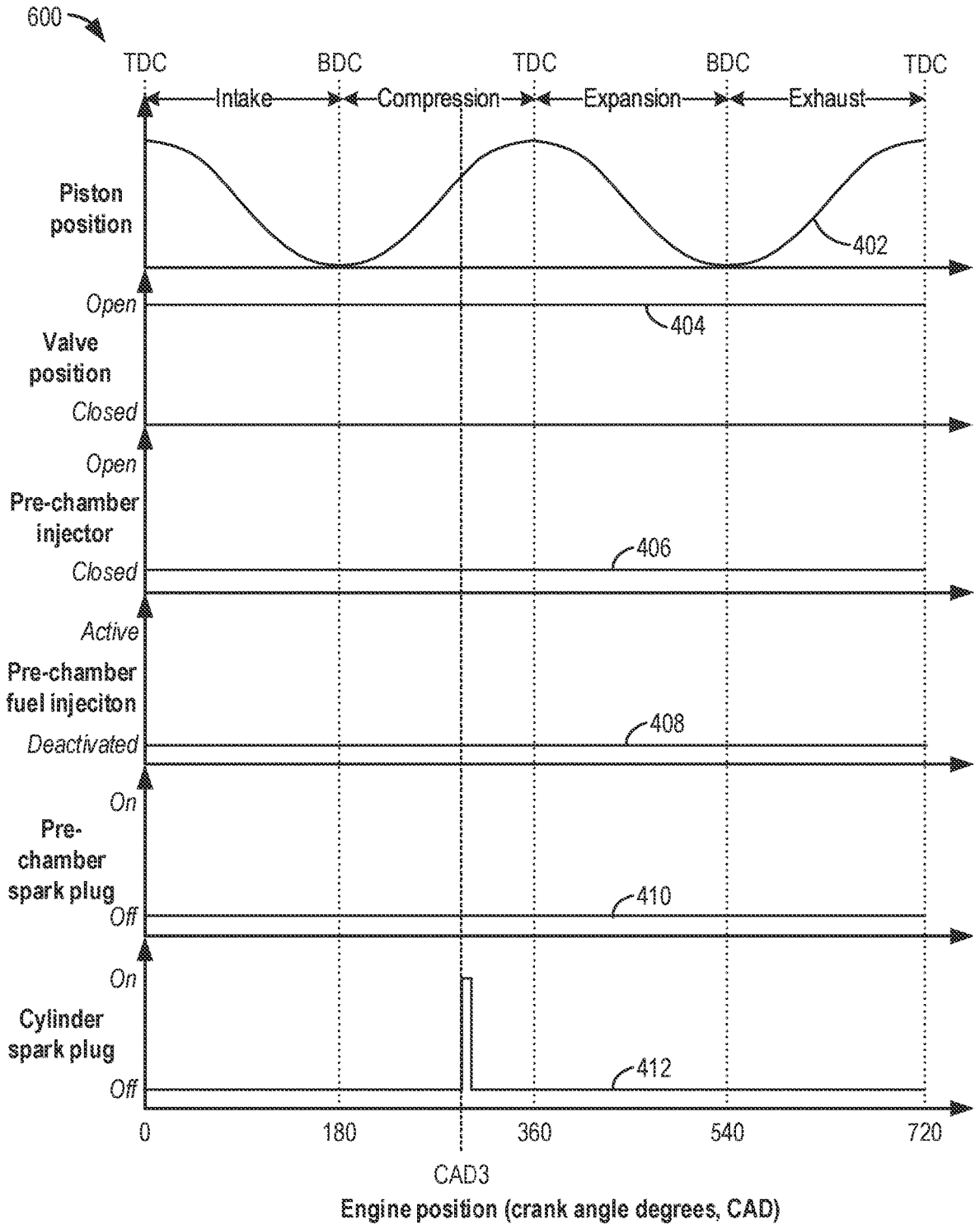
FIG. 6 shows an example timing chart of operating a turbulent jet ignition system in an exhaust runner thermactor mode.
Figure 7:
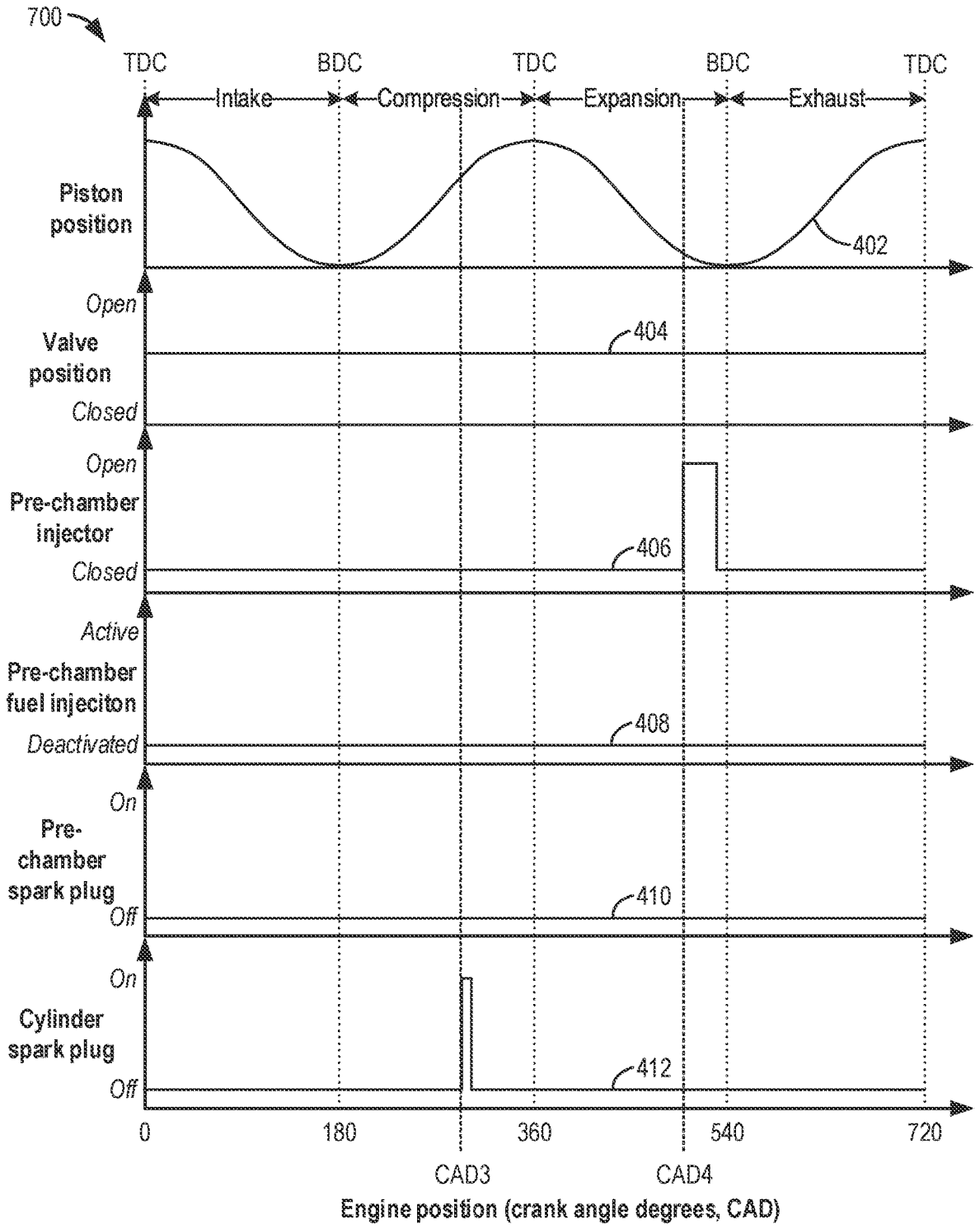
FIG. 7 shows an example timing chart of operating a turbulent jet ignition system in a combined thermactor mode.
Figure 8:
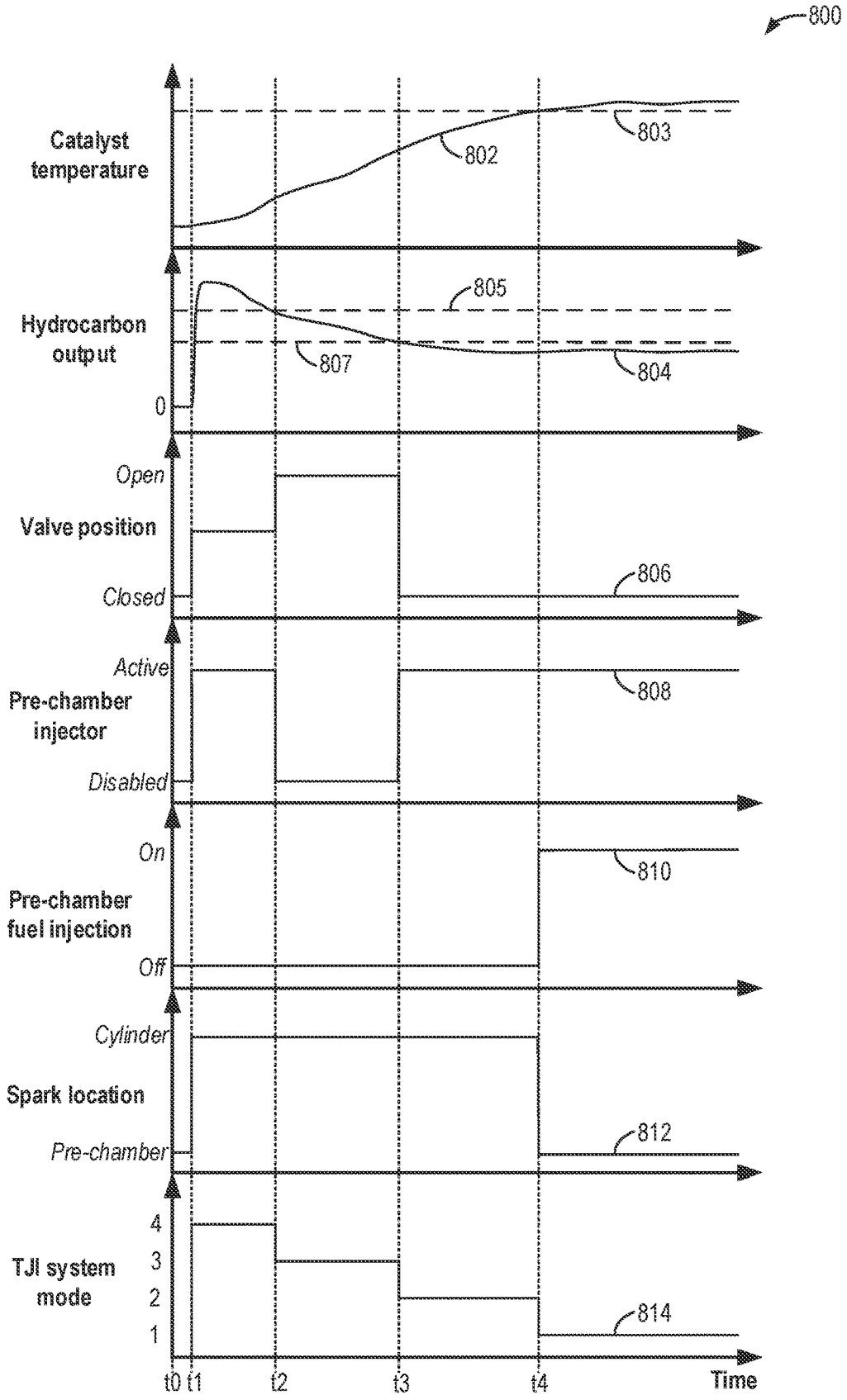
FIG. 8 shows an example timeline of adjusting operation of a turbulent jet ignition system to provide secondary air injection or ignition.

Next, FIGS. 4-7 show example timing charts demonstrating operating a TJI system of an engine in different operating modes. In FIG. 4, a first example timing chart 400 demonstrates operating the TJI system in an ignition mode. An example of operating the TJI system in the ignition mode is described above with respect to FIGS. 2A and 3. In FIG. 5, a second example timing chart 500 demonstrates operating the TJI system in an in-cylinder thermactor mode, which is described above with respect to FIGS. 2B and 3, for example. In FIG. 6, a third example timing chart 600 demonstrates operating the TJI system in an exhaust runner thermactor mode. For example, exhaust runner thermactor mode is described above with respect to FIGS. 2C and 3. In FIG. 7, a fourth example timing chart 700 demonstrates operating the TJI system in a combined thermactor mode, as described above with respect to FIGS. 2D and 3, for example. Within all of the example timing charts, a piston position is shown in plot 402, a valve position is shown in plot 404, a status of a pre-chamber injector is shown in plot 406, a status of pre-chamber fuel injection is shown in plot 408, a status of a pre-chamber spark plug is shown in plot 410, and a status of a cylinder spark plug is shown in plot 412.

For all of the above, the horizontal axis represents engine position (in crank angle degrees, CAD), with the engine position increasing along the horizontal axis from left to right. For example, as mentioned above, one four-stroke engine cycle is shown, which occurs from 0 to 720 CAD (e.g., two full rotations of an engine crankshaft). In the example timing charts, the intake stroke corresponds to an interval from 0 CAD to 180 CAD, the compression stroke corresponds to an interval from 180 CAD to 360 CAD, the expansion (or power) stroke corresponds to an interval from 360 CAD to 540 CAD, and the exhaust stroke corresponds to an interval from 540 CAD to 720 CAD. The vertical axis of each plot represents the labeled parameter. For plot 402, the vertical axis shows piston position relative to TDC and BDC. For plots 404 and 406, the vertical axis shows the valve position (plot 404) and the pre-chamber injector (plot 406) ranging from "closed," which refers to a fully closed position, and "open," which refers to a fully open position. For plot 408, the vertical axis shows the pre-chamber fuel injection as "active," in which fuel is provided to the TJI system, or "inactive," in which fuel is not provided to the TJI system. For plots 410 and 412, the vertical axis indicates whether the corresponding spark plug is on (e.g., the corresponding spark plug is actuated) or off (e.g., the corresponding spark plug is not actuated), as labeled.

Turning first to FIG. 4, the first example timing chart 400 shows an example of operating the TJI systems in the ignition mode. For example, the ignition mode is selected when a cold start condition is not present in a vehicle, as described with respect to FIG. 3. In plot 404, the valve position (e.g., valve 212 of FIG. 2, also referred to as the exhaust runner supply valve) is fully closed throughout the four-stroke cycle. As a result, additional air is not supplied to exhaust runners to oxidize unburnt hydrocarbons after combustion in the cylinder has occurred. The pre-chamber fuel injection is active so that fuel is provided to all of the pre-chambers of the engine (plot 408). In plot 406, the pre-chamber injector (e.g., pre-chamber injector 94 shown in FIG. 1) is in a closed position until the piston position (plot 402) is approximately half-way between BDC and TDC during the compression stroke at crank angle degree 1 (CAD1). At CAD1, the pre-chamber injector is actuated fully open by the controller. As a result, the pre-chamber injector injects an air-fuel mixture into the pre-chamber that may be used for combustion in the pre-chamber. Later within the compression stroke, when the piston is closer to TDC (plot 402), the pre-chamber spark plug (plot 410) is actuated at CAD2. This causes the air-fuel mixture in the pre-chamber to combust and sends a jet of flame from the pre-chamber to the cylinder. Since the pre-chamber spark plug acts as an ignition source for the cylinder when actuated, the cylinder spark plug (plot 412) remains off throughout the four-stroke engine cycle.

Continuing to FIG. 5, the second example timing chart 500 shows the TR system operating in the in-cylinder thermactor mode. The in-cylinder thermactor mode is used when a cold start condition is present and there is a relatively low emission of hydrocarbons from the engine (e.g., during a third operating condition), as elaborated above with respect to FIG. 3. At CAD3, which is within the compression stoke, the cylinder spark plug (plot 412) is actuated to provide a spark to combust an air-fuel mixture within the cylinder. At the end of the expansion stroke, the pre-chamber injector (plot 406) injects air into the pre-chamber that may oxidize any unburnt hydrocarbons that exist in the cylinder after combustion. Throughout the four-stroke engine cycle, the valve is maintained closed (plot 404). The valve blocks air from flowing from a compressor (e.g., compressor 190 shown in FIG. 1) to the exhaust runners. Thus, secondary air is provided only via the pre-chamber. Throughout the four-stroke engine cycle, the pre-chamber fuel injection (plot 408) and pre-chamber spark plug (plot 410) remain off due to the pre-chamber providing secondary air to the cylinder but not providing an ignition source.

Within the third example timing chart 600 of FIG. 6, the TJI system is operated in the exhaust runner thermactor mode. The exhaust runner thermactor mode may be used when the second operating condition is present, which is elaborated above with respect to FIG. 3. Within the exhaust runner thermactor mode, ignition is not provided by the pre-chamber, and as such, the pre-chamber injector (plot 406) remains closed, the pre-chamber fuel injection (plot 408) is deactivated, and the pre-chamber spark plug (plot 410) is not actuated. However, combustion still occurs in the cylinder due to the cylinder spark plug (plot 412) actuating within the compression stroke at CAD3. The valve position (plot 404) remains open throughout the four-stroke cycle, allowing secondary air to flow into the exhaust runners to oxidize the unburnt hydrocarbons that remain after combustion occurs within the cylinder.

Turning now to FIG. 7, the TJI system is operated in the combined thermactor mode, such as during a first operating condition elaborated above with respect to FIG. 3. The pre-chamber fuel injection (plot 408) and pre-chamber spark plug (plot 410) are off due to the TJI system acting as a thermactor and because combustion in the cylinder is ignited by the cylinder spark plug (plot 412), which occurs at CAD3 within the compression stroke. The valve position (plot 404) is partially open throughout the four-stroke cycle, thus allowing additional air to flow to the exhaust runners; however, as the valve is partially open, air flow through the valve is reduced compared to when the TJI system is operated in the exhaust runner thermactor mode, such as shown in FIG. 6. However, air is also provided to the cylinder by actuating the pre-chamber injector (plot 406) open during the expansion stroke at CAD4. In this way, hydrocarbons left unburnt after combustion occurs in the cylinder may be oxidized within the cylinder by reacting with the air injected into the pre-chamber, and further, any unburnt hydrocarbons in the exhaust runner may be oxidized by the secondary air provided to the exhaust runners through the valve.

Turning now to FIG. 8, an example timeline 800 for adjusting a TJI system of an engine between different operating modes based on at least a catalyst temperature is shown. The engine may be engine 10 shown in FIG. 1 including TJI system 195, for example. As another example, the TJI system may be extended TJI system 200 shown in FIGS. 2A-2D. A catalyst temperature is shown in plot 802, a temperature threshold is shown in dashed line 803 (e.g., the second threshold temperature discussed in FIG. 3), a hydrocarbon output is shown in plot 804, an upper hydrocarbon threshold is shown by a dashed line 805, a lower hydrocarbon threshold is shown by a dashed line 807, a valve position is shown in plot 806 (e.g., valve 212 shown in FIGS. 2A-2D), a pre-chamber injector status (e.g., of pre-chamber injector 94 shown in FIG. 1) is shown in plot 808, a pre-chamber fuel injection status is shown in plot 810, a spark location is shown in plot 812, and a TJI system mode is shown in plot 814.

For all of the above, the horizontal axis represents time, with time increasing along the horizontal axis from left to right. The vertical axis represents each labeled parameter. For plots 802 and 804, the catalyst temperature and hydrocarbon output, respectively, increase up the vertical axis from bottom to top. For plot 806, the valve position may range from a fully open position to a fully closed position. For example, decreasing along the vertical axis causes the valve position to further close while increasing along the vertical axis causes the valve position to further open. For plot 808, the vertical axis indicates whether the pre-chamber injector is in an active or a disabled state. As an example, while in the active state the pre-chamber injector may inject air and/or fuel into a pre-chamber during specific times in a four-stroke engine cycle depending on which TJI system mode is selected. While in the disabled state, the pre-chamber injector does not inject air and/or fuel into the pre-chamber. For plot 810, the vertical axis indicates whether the pre-chamber fuel injection is on (e.g., a pre-chamber fuel injector may deliver fuel to the TJI system) or off (e.g., the pre-chamber fuel injector may not deliver fuel to the TJI system), as labeled. For plot 812, the vertical axis represents the spark location, which may either be in a cylinder (e.g., cylinder 130 of FIG. 1) or in the pre-chamber (e.g., pre-chamber 138 of FIG. 1). For example, if the spark location is in the cylinder, a cylinder spark plug (e.g., main chamber spark plug 93 shown in FIG. 1) is actuated at a desired ignition timing. As a further example, if the spark location is in the pre-chamber, then a pre-chamber spark plug (e.g., pre-chamber spark plug 92 shown in FIG. 1) is actuated at the desired ignition timing. For plot 814, the TJI system may be operated in four different modes. The first mode, labeled as 1, is the ignition mode. As an example, the ignition mode is shown in FIGS. 2A and 4. The second mode, labeled as 2, is the in-cylinder thermactor mode (e.g., the in-cylinder thermactor mode shown in FIGS. 2B and 5). The third mode, labeled as 3, is the exhaust runner thermactor mode, an example of which is shown in FIGS. 2C and 6, and the fourth mode, labeled as 4, is the combined thermactor mode. Examples of the combined thermactor mode can be found in FIGS. 2D and 7.

Further, a threshold catalyst temperature is represented by a dashed line 803 and corresponds to a light-off temperature of the catalyst. The threshold catalyst temperature corresponds to a non-zero, positive temperature value stored in a memory of a controller (e.g., controller 12 of FIG. 1), above which the temperature of the catalyst is efficient at oxidizing hydrocarbons. Below the threshold catalyst temperature, it may be determined that the engine is in a cold start condition, as the engine is not in a warm, steady state condition. In addition to the threshold catalyst temperature, there is also the upper hydrocarbon threshold (dashed line 805) and the lower hydrocarbon threshold (dashed line 807). Both of the upper and lower hydrocarbon thresholds are non-zero, positive hydrocarbon output valves stored in the memory of the controller.

From time t0 to time t1, the engine is off and the catalyst temperature (plot 802) reflects the ambient temperature of the environment in which the catalyst is located. At time t1, the engine is turned on. For example, the engine may be turned on responsive to input of a key turning, push of a start button, etc. by a vehicle operator (e.g., vehicle operator 113 shown in FIG. 1). The catalyst temperature (plot 802) is low and below the threshold catalyst temperature shown by dashed line 803, indicating a cold start condition is present. After the engine is started at time t1, the hydrocarbon output (plot 804) increases rapidly due the engine starting up. Additionally, the catalyst temperature is too low to effectively burn hydrocarbons that do not combust. As a result of the cold start condition and in anticipation of the hydrocarbon output being above the upper hydrocarbon threshold (e.g., the first operating condition described with respect to FIG. 3 is present), the TJI system is operated in the combined thermactor mode (TJI system mode 4 shown by plot 814).

To operate in the combined thermactor mode, the pre-chamber injector (plot 808) is active and the valve is adjusted to a partially open position (plot 806). Near BDC in the expansion stroke and/or near TDC of the exhaust stroke, the pre-chamber injector injects air into the pre-chamber (e.g., a first secondary air introduction location), providing air that may oxidize any unburnt hydrocarbons in the cylinder. Further, additional air is provided to exhaust runners (e.g., exhaust runners 86*a*, 86*b*, and 86*n* from FIGS. 2A-2D, a second secondary air introduction location) via the partially open valve so that unburnt hydrocarbons exhausted from the cylinder may be oxidized by the addition of air. The spark location (plot 812) in the combined thermactor mode is within the cylinder so that combustion is initiated by the cylinder spark plug. Additionally, since the spark location is within the cylinder and the pre-chamber is used to provide secondary air injection and is not used to provide ignition, the pre-chamber fuel injection (plot 810) is turned off.

From time t1 to time t2, as the TJI system operates in the combined thermactor mode, the temperature of the catalyst (plot 802) increases and the hydrocarbon output (plot 804) decreases due to the combined thermactor mode oxidizing unburnt hydrocarbons. However, the catalyst temperature (plot 802) remains below the threshold catalyst temperature (dashed line 803), and as such, the catalyst remains inefficient at treating hydrocarbon emissions. At time t2, the hydrocarbon output decreases below the upper hydrocarbon threshold (dashed line 805) and remains above the lower hydrocarbon threshold (dashed line 807). In response, the TJI system mode is adjusted to the exhaust runner thermactor mode (TJI system mode 3 shown by plot 814).

The exhaust runner thermactor mode provides secondary air to the exhaust runners, and not the pre-chamber, to oxidize unburnt hydrocarbons. In response to the exhaust runner thermactor mode being selected at time t2, the valve position (plot 806) is adjusted to a fully open position, enabling more air to flow to the exhaust runners. The pre-chamber injector (plot 808) is disabled, stopping the pre-chamber injector from injecting air into the pre-chamber. Similar to the combined thermactor mode, the spark location (plot 812) is in the cylinder, and the pre-chamber fuel injection (plot 810) is turned off. Thus, combustion occurs in the cylinder without combustion in the pre-chamber initiating the combustion in the cylinder.

By time t3, the catalyst temperature (plot 802), although increasing, is still below the threshold catalyst temperature (dashed line 803). Since the catalyst temperature is below the threshold temperature, the catalyst is still inefficient in burning hydrocarbons that were not burned during combustion within the cylinder. Also at time t3, the hydrocarbon output (plot 804) decreases below the lower hydrocarbon threshold (dashed line 807) due in part to the hydrocarbon oxidation provided by operating the TJI system in the exhaust runner thermactor mode. In response to the hydrocarbon output decreasing below the lower hydrocarbon threshold at time t3, the TJI mode is transitioned to operating in the in-cylinder thermactor mode (TJI system mode 2 shown in plot 814).

To transition the TJI system to operating in the in-cylinder thermactor mode at time t3, the valve is adjusted from the fully open position to the fully closed position (plot 806). With the valve closed, air is no longer provided to the exhaust runners. Instead, the pre-chamber injector (plot 808) is activated to inject air into the pre-chamber late in the expansion stroke and/or during the exhaust stroke, and the injected air flows into the cylinder. The addition of air to cylinder by the pre-chamber injector may oxidize unburnt hydrocarbons that are not consumed during combustion in the cylinder. Similar to both the combined thermactor mode and the exhaust runner thermactor mode, the spark location (plot 812) is within the cylinder, and the pre-chamber fuel injection (plot 810) is turned off due to combustion being initiated directly within the cylinder by the cylinder spark plug.

At time t4, the catalyst temperature (plot 802) increases above the threshold catalyst temperature (dashed line 803). As such, the catalyst has reached its light-off temperature and is maximally effective at oxidizing hydrocarbons output by the engine. Additionally, the catalyst temperature increasing above the threshold catalyst temperature indicates that the cold start condition is no longer present in the engine. As a result, the TJI system is adjusted to the pre-chamber ignition mode (TJI system mode 1 shown in plot 814). In the pre-chamber ignition mode, the TJI system provides ignition to the cylinder via combustion within the pre-chamber, and the TJI system is no longer operated to provide secondary air injection for reducing hydrocarbon emissions. The valve position (plot 806) is kept in a fully closed position, preventing air from flowing through the valve to the exhaust runners. Pre-chamber fuel injection (plot 810) is turned on, allowing fuel to be injected into a common delivery passage (e.g., common delivery passage 208 shown in FIGS. 2A-2D). The fuel injected into the common delivery passage mixes with the air to create an air-fuel mixture. The pre-chamber injector (plot 808) remains active, but instead of injecting air into the pre-chamber as described for the combined thermactor mode and the in-cylinder thermactor mode, the pre-chamber injector injects the air-fuel mixture into the pre-chamber. To combust the air-fuel mixture within the pre-chamber, the spark location (plot 812) is within the pre-chamber beginning at time t4. The pre-chamber spark plug ignites the air-fuel mixture, causing jets of flames to enter the cylinder from the pre-chamber which then ignite an air-fuel mixture within the cylinder, providing combustion torque.

In this way, by providing secondary air at one or more introduction locations, a quantity of unburned hydrocarbons that are delivered to the catalyst prior to the catalyst reaching its light-off temperature are reduced. Further, the exothermic reaction between the secondary air and the hydrocarbons may help the catalyst may reach its light-off temperature more quickly, after which it may more efficiently reduce exhaust emissions (e.g., by oxidizing the unburned hydrocarbons). As a result, overall vehicle emissions are reduced. Further, vehicle costs and complexity may be reduced by providing the secondary air via the turbulent jet ignition system compared with including an external thermactor pump and delivery lines.

The technical effect of providing secondary air to a pre-chamber and/or an exhaust runner of a cylinder and via a turbulent jet ignition system during a cold start is that the secondary air may provide additional oxidation of hydrocarbons prior to a catalyst reaching its light-off temperature.

As one example, a method comprises: during heating of a catalyst of an exhaust system coupled to an engine, initiating combustion in a cylinder via a spark plug directly coupled to the cylinder and providing secondary air via a turbulent jet system having an igniter. In a first example of the method, the turbulent jet system includes a compressor positioned in an air delivery passage, a pre-chamber coupled to the cylinder, and a pre-chamber injector coupled to the pre-chamber and to the air delivery passage, downstream of the compressor, via a first port, and wherein providing the secondary air via the turbulent jet system comprises pressurizing the secondary air via the compressor. In a second example of the method, optionally including the first example, providing the secondary air via the turbulent jet system further comprises injecting the secondary air into the pre-chamber via the pre-chamber injector during at least one of an expansion stroke and an exhaust stroke of the cylinder. In a third example of the method, optionally including one or both of the first and second examples, the turbulent jet system further includes a valve disposed in the air delivery passage downstream of the first port and upstream of a second port coupling the air delivery passage to an exhaust runner of the cylinder, and wherein providing the secondary air via the turbulent jet system further comprises adjusting a position of the valve. In a fourth example of the method, optionally including any or all of the first through third examples, adjusting the position of the valve comprises: adjusting the position of the valve to a first open position responsive to a first operating condition, adjusting the position of the valve to a second open position, greater than the first open position, responsive to a second operating condition, and adjusting the position of the valve to a fully closed position responsive to a third operating condition. In a fifth example of the method, optionally including any or all of the first through fourth examples, the first operating condition includes a hydrocarbon output of the engine being greater than a first, higher threshold, the second operating condition includes the hydrocarbon output of the engine being both less than the first, higher threshold and greater than a second, lower threshold, and the third operating condition includes the hydrocarbon output of the engine being less than the second, lower threshold. In a sixth example of the method, optionally including any or all of the first through fifth examples, the first operating condition includes a duration of operating the engine being less than a first threshold duration, the second operating condition includes the duration of operating the engine being both greater than the first threshold duration and less than a second threshold duration, the second threshold duration being greater than the first threshold duration, and the third operating condition includes the duration of operating the engine being greater than the second threshold duration. In a seventh example of the method, optionally including any or all of the first through sixth examples, providing the secondary air via the turbulent jet system further comprises injecting the secondary air into the pre-chamber via the pre-chamber injector during at least one of an expansion stroke and an exhaust stroke of the cylinder during the first operating condition and the third operating condition and not during the second operating condition. In an eighth example of the method, optionally including any or all of the first through seventh examples, the heating of the catalyst is responsive to a temperature of the catalyst being less than a threshold temperature, and the method further comprises: in response to the temperature of the catalyst reaching the threshold temperature, initiating combustion in the cylinder via the igniter of the turbulent jet system and not via the spark plug directly coupled to the cylinder. In a ninth example of the method, optionally including any or all of the first through eighth examples, the igniter of the turbulent jet system is coupled to the pre-chamber, and initiating combustion in the cylinder via the turbulent jet system comprises: injecting fuel into the air delivery passage via a fuel injector coupled to the air delivery passage upstream of the first port to generate an air-fuel mixture, injecting the air-fuel mixture into the pre-chamber via the pre-chamber injector during a compression stroke of the cylinder, and after injecting the air-fuel mixture into the pre-chamber, actuating the igniter at a desired ignition timing.

As another example, a method comprises: during a cold start of an engine: disabling fuel supply to a turbulent jet system having an igniter, and providing air to at least one secondary air introduction location coupled to a cylinder of the engine via the turbulent jet system. In a first example of the method, the turbulent jet system includes a pre-chamber fluidically coupled to the cylinder via a plurality of openings in pre-chamber walls dividing an internal volume of the pre-chamber from an internal volume of the cylinder, wherein the igniter is positioned in the pre-chamber, and wherein the at least one secondary air introduction location includes the pre-chamber. In a second example of the method, optionally including the first example, providing the air to the at least one secondary air introduction location comprises injecting air into the pre-chamber during at least one of an expansion stroke of the cylinder and an exhaust stroke of the cylinder. In a third example of the method, optionally including one or both of the first and second examples, the turbulent jet system is fluidically coupled to an exhaust runner of the cylinder, and wherein the at least one secondary air introduction location includes the exhaust runner. In a fourth example of the method, optionally including any or all of the first through third examples, providing the air to the at least one secondary air introduction location comprises at least partially opening a valve positioned to regulate a flow of the air to the exhaust runner. In a fifth example of the method, optionally including any or all of the first through fourth examples, providing the air to the at least one secondary air introduction location comprises selecting between providing the air to the pre-chamber, providing air to the exhaust runner, and providing the air to both of the pre-chamber and the exhaust runner based on an estimated hydrocarbon output of the engine.

In yet another example, a system comprises: an engine including a plurality of cylinders, each of the plurality of cylinders including a pre-chamber of a turbulent jet ignition (TJI) system, the pre-chamber including a first spark plug coupled thereto, and a controller storing including executable instructions stored in non-transitory memory that, when executed, cause the controller to: operate the TJI system in a thermactor mode responsive to a cold start condition of the engine, and operate the TJI system in an ignition mode responsive to the cold start condition of the engine not being present. In a first example of the system, the TJI system comprises a compressor positioned in an air delivery passage fluidically coupled to an injector of the pre-chamber of each of the plurality of cylinders, downstream of the compressor, and a pre-chamber fuel injector coupled to the air delivery passage upstream of the compressor, and wherein to operate the TJI system in the thermactor mode, the controller includes further instructions stored in non-transitory memory that, when executed, cause the controller to: disable the pre-chamber fuel injector, and operate the compressor. In a second example of the system, optionally including the first example, the air delivery passage is further coupled to an exhaust runner of each of the plurality of cylinders and includes a valve disposed upstream of the exhaust runner of each of the plurality of cylinders and downstream of the injector of the pre-chamber of each of the plurality of cylinders, and wherein to operate the TJI system in the thermactor mode, the controller includes further instructions stored in non-transitory memory that, when executed, cause the controller to: partially open the valve to deliver air from the air delivery passage to the exhaust runner and also deliver air from the air delivery passage to the pre-chamber via the injector responsive to a first condition, the first condition including at least one of a hydrocarbon output of the engine being greater than a first threshold and a duration of operating the engine being less than a first threshold duration, fully open the valve to deliver air from the air delivery passage to the exhaust runner and maintain the injector fully closed responsive to a second condition, the second condition including at least one of the hydrocarbon output of the engine being both less than the first threshold and greater than a second threshold and the duration of operating the engine being both greater than the first threshold duration and less than a second threshold duration, and deliver air from the air delivery passage to the pre-chamber via the injector while maintaining the valve fully closed responsive to a third condition, the third condition including at least one of the hydrocarbon output of the engine being less than the second threshold and the duration of operating the engine being greater than the second threshold duration. In a third example of the system, optionally including one or both of the first and second examples, each of the plurality of cylinders further includes a second spark plug directly coupled thereto, and the controller includes further instructions stored in non-transitory memory that, when executed, cause the controller to: actuate the second spark plug at a desired ignition timing while operating the TJI system in the thermactor mode, and actuate the first spark plug at the desired ignition timing while operating the TJI system in the ignition mode.

In another representation, a method comprises: during heating of a catalyst of an exhaust system coupled to an engine, initiating combustion in a cylinder via a turbulent jet ignition system at a first timing during a combustion cycle of the cylinder and providing secondary air via the turbulent jet ignition system during a second timing during the combustion cycle. In the preceding example, additionally or optionally, the first timing is during a compression stroke of the cylinder, and the second timing is during an expansion stroke of the cylinder. In one or both of the preceding examples, additionally or optionally, the first timing is during a compression stroke of the cylinder, and the second timing is during an exhaust stroke of the cylinder. In any or all of the preceding examples, additionally or optionally, initiating combustion in the cylinder via the turbulent jet ignition system comprises: injecting air and fuel into a pre-chamber of the turbulent jet ignition system; and actuating a spark plug coupled in the pre-chamber after injecting the air and the fuel. In any or all of the preceding examples, additionally or optionally, providing secondary air via the turbulent jet ignition system comprises injecting air and not injecting fuel into the pre-chamber. In any or all of the preceding examples, additionally or optionally, injecting air and fuel into the pre-chamber of the turbulent jet ignition system comprises: injecting air via an air injector directly coupled to the pre-chamber and injecting fuel via a fuel injector directly coupled to the pre-chamber. In any or all of the preceding examples, additionally or optionally, the air injector directly coupled to the pre-chamber is coupled to an air compressor via an air delivery passage, and wherein injecting air via the air injector directly coupled to the pre-chamber further comprises operating the air compressor at a non-zero speed. In any or all of the preceding examples, additionally or optionally, a pressure in the air delivery passage is greater than a pressure in the cylinder at both of the first timing and the second timing. In any or all of the preceding examples, additionally or optionally, after the heating of the catalyst, initiating combustion in the cylinder via the turbulent jet ignition system and not providing the secondary air via the turbulent jet ignition system.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

during heating of a catalyst of an exhaust system coupled to an engine, initiating combustion in a cylinder via a spark plug directly coupled to the cylinder and providing secondary air via a turbulent jet system having an igniter, wherein the turbulent jet system includes a compressor positioned in an air delivery passage, a pre-chamber coupled to the cylinder, and a pre-chamber injector coupled to the pre-chamber and to the air delivery passage, downstream of the compressor, via a first port, and wherein providing the secondary air via the turbulent jet system comprises pressurizing the secondary air via the compressor.

2. The method of claim 1, wherein providing the secondary air via the turbulent jet system further comprises injecting the secondary air into the pre-chamber via the pre-chamber injector during at least one of an expansion stroke and an exhaust stroke of the cylinder.

3. The method of claim 1, wherein the turbulent jet system further includes a valve disposed in the air delivery passage downstream of the first port and upstream of a second port coupling the air delivery passage to an exhaust runner of the cylinder, and wherein providing the secondary air via the turbulent jet system further comprises adjusting a position of the valve.

4. The method of claim 3, wherein adjusting the position of the valve comprises:

adjusting the position of the valve to a first open position responsive to a first operating condition;

adjusting the position of the valve to a second open position, greater than the first open position, responsive to a second operating condition; and adjusting the position of the valve to a fully closed position responsive to a third operating condition.

5. The method of claim 4, wherein the first operating condition includes a hydrocarbon output of the engine being greater than a first, higher threshold, the second operating condition includes the hydrocarbon output of the engine being both less than the first, higher threshold and greater than a second, lower threshold, and the third operating condition includes the hydrocarbon output of the engine being less than the second, lower threshold.

6. The method of claim 4, wherein the first operating condition includes a duration of operating the engine being less than a first threshold duration, the second operating condition includes the duration of operating the engine being both greater than the first threshold duration and less than a second threshold duration, the second threshold duration being greater than the first threshold duration, and the third operating condition includes the duration of operating the engine being greater than the second threshold duration.

7. The method of claim 4, wherein providing the secondary air via the turbulent jet system further comprises injecting the secondary air into the pre-chamber via the pre-chamber injector during at least one of an expansion stroke and an exhaust stroke of the cylinder during the first operating condition and the third operating condition and not during the second operating condition.

8. The method of claim 1, wherein the heating of the catalyst is responsive to a temperature of the catalyst being less than a threshold temperature, and the method further comprises:

in response to the temperature of the catalyst reaching the threshold temperature, initiating combustion in the cylinder via the igniter of the turbulent jet system and not via the spark plug directly coupled to the cylinder.

9. The method of claim 8, wherein the igniter of the turbulent jet system is coupled to the pre-chamber, and initiating combustion in the cylinder via the turbulent jet system comprises:

injecting fuel into the air delivery passage via a fuel injector coupled to the air delivery passage upstream of the first port to generate an air-fuel mixture;

injecting the air-fuel mixture into the pre-chamber via the pre-chamber injector during a compression stroke of the cylinder; and after injecting the air-fuel mixture into the pre-chamber, actuating the igniter at a desired ignition timing.

10. A method, comprising:

during a cold start of an engine:

disabling fuel supply to a turbulent jet system having an igniter; and providing air to at least one secondary air introduction location coupled to a cylinder of the engine via the turbulent jet system, wherein the turbulent jet system includes a pre-chamber fluidically coupled to the cylinder via a plurality of openings in pre-chamber walls dividing an internal volume of the pre-chamber from an internal volume of the cylinder, wherein the igniter is positioned in the pre-chamber, and wherein the at least one secondary air introduction location includes the pre-chamber, wherein providing the air to the at least one secondary air introduction location comprises injecting air into the pre-chamber during at least one of an expansion stroke of the cylinder and an exhaust stroke of the cylinder.

11. The method of claim 10, wherein the turbulent jet system is fluidically coupled to an exhaust runner of the cylinder, and wherein the at least one secondary air introduction location includes the exhaust runner.

12. The method of claim 11, wherein providing the air to the at least one secondary air introduction location comprises at least partially opening a valve positioned to regulate a flow of the air to the exhaust runner.

13. The method of claim 11, wherein providing the air to the at least one secondary air introduction location comprises selecting between providing the air to the pre-chamber, providing air to the exhaust runner, and providing the air to both of the pre-chamber and the exhaust runner based on an estimated hydrocarbon output of the engine.

14. A system, comprising:

an engine including a plurality of cylinders, each of the plurality of cylinders including a pre-chamber of a turbulent jet ignition (TJI) system, the pre-chamber including a first spark plug coupled thereto; and a controller storing including executable instructions stored in non-transitory memory that, when executed, cause the controller to:

operate the TJI system in a thermactor mode responsive to a cold start condition of the engine; and operate the TJI system in an ignition mode responsive to the cold start condition of the engine not being present.

15. The system of claim 14, wherein the TJI system comprises a compressor positioned in an air delivery passage fluidically coupled to an injector of the pre-chamber of each of the plurality of cylinders, downstream of the compressor, and a pre-chamber fuel injector coupled to the air delivery passage upstream of the compressor, and wherein to operate the TJI system in the thermactor mode, the controller includes further instructions stored in non-transitory memory that, when executed, cause the controller to:

disable the pre-chamber fuel injector; and operate the compressor.

16. The system of claim 15, wherein the air delivery passage is further coupled to an exhaust runner of each of the plurality of cylinders and includes a valve disposed upstream of the exhaust runner of each of the plurality of cylinders and downstream of the injector of the pre-chamber of each of the plurality of cylinders, and wherein to operate the TJI system in the thermactor mode, the controller includes further instructions stored in non-transitory memory that, when executed, cause the controller to:

partially open the valve to deliver air from the air delivery passage to the exhaust runner and also deliver air from the air delivery passage to the pre-chamber via the injector responsive to a first condition, the first condition including at least one of a hydrocarbon output of the engine being greater than a first threshold and a duration of operating the engine being less than a first threshold duration;

fully open the valve to deliver air from the air delivery passage to the exhaust runner and maintain the injector fully closed responsive to a second condition, the second condition including at least one of the hydrocarbon output of the engine being both less than the first threshold and greater than a second threshold and the duration of operating the engine being both greater than the first threshold duration and less than a second threshold duration; and deliver air from the air delivery passage to the pre-chamber via the injector while maintaining the valve fully closed responsive to a third condition, the third condition including at least one of the hydrocarbon output of the engine being less than the second threshold and the duration of operating the engine being greater than the second threshold duration.

17. The system of claim 14, wherein each of the plurality of cylinders further includes a second spark plug directly coupled thereto, and the controller includes further instructions stored in non-transitory memory that, when executed, cause the controller to:

actuate the second spark plug at a desired ignition timing while operating the TJI system in the thermactor mode; and actuate the first spark plug at the desired ignition timing while operating the TJI system in the ignition mode.

* * * * *